US009977369B2

(12) United States Patent
Nagura et al.

(10) Patent No.: US 9,977,369 B2
(45) Date of Patent: May 22, 2018

(54) DEVELOPER CONVEYING APPARATUS AND DEVELOPING APPARATUS

(71) Applicant: CANON FINETECH INC., Saitama (JP)

(72) Inventors: Hideo Nagura, Yoshikawa (JP); Chihiro Tanaka, Kashiwa (JP); Masashi Wakisaka, Misato (JP); Naoki Tamaru, Kashiwa (JP); Ryo Nakajima, Nagareyama (JP); Tsuyoshi Takahashi, Matsudo (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 0 days. days.

(21) Appl. No.: 14/976,254

(22) Filed: Dec. 21, 2015

(65) Prior Publication Data

US 2016/0187813 A1 Jun. 30, 2016

(30) Foreign Application Priority Data

Dec. 24, 2014 (JP) ..... 2014-259856
Dec. 24, 2014 (JP) ..... 2014-259857
(Continued)

(51) Int. Cl.
*G03G 15/08* (2006.01)

(52) U.S. Cl.
CPC ..... *G03G 15/0891* (2013.01); *G03G 15/0893* (2013.01); *G03G 2215/085* (2013.01)

(58) Field of Classification Search
CPC ..... G03G 15/0822; G03G 15/0887–15/0893; G03G 2215/0802; G03G 2215/0816; G03G 2215/0838; G03G 2215/085
See application file for complete search history.

(56) References Cited

U.S. PATENT DOCUMENTS 6,026,263 A * 2/2000 Nakahata ..... G03G 15/0822 399/102
6,542,709 B1 * 4/2003 Wang ..... G03G 15/0868 399/263
(Continued)

FOREIGN PATENT DOCUMENTS

EP 1 998 231 A1 12/2008
JP H05-72952 A 3/1993
(Continued)

OTHER PUBLICATIONS

European Search Report dated May 23, 2016, in related European Patent Application No. 15202287.7.

*Primary Examiner* — Carla Therrien
(74) *Attorney, Agent, or Firm* — Fitzpatrick, Cella, Harper & Scinto

(57) ABSTRACT

A developer conveying apparatus for conveying a developer that develops an electrostatic latent image includes a rotation unit which rotates around a rotation shaft extending in an axial direction and parallel to a developer conveying direction, a first developer conveying portion which is provided in the rotation unit and which has an opening configured to convey the developer in a first axial direction of the rotation shaft, and a second developer conveying portion which is provided in the rotation unit and which has an opening configured to convey the developer in a second axial direction opposite to the first axial direction. A distance from the rotation shaft to the opening in the first developer conveying portion is different than a distance from the rotation shaft to the opening in the second developer conveying portion.

29 Claims, 43 Drawing Sheets

(30) Foreign Application Priority Data

| | | |
|---|---|---|
| Dec. 24, 2014 | (JP) | 2014-259858 |
| Dec. 24, 2014 | (JP) | 2014-259859 |
| Dec. 24, 2014 | (JP) | 2014-259860 |
| Dec. 24, 2014 | (JP) | 2014-259861 |

(56) References Cited

U.S. PATENT DOCUMENTS

| | | | | |
|---|---|---|---|---|
| 7,174,123 | B1 * | 2/2007 | Miller | G03G 21/12 399/263 |
| 2001/0008591 | A1 * | 7/2001 | Kaneshige | G03G 15/0822 399/258 |
| 2006/0222414 | A1 * | 10/2006 | Yamamura | G03G 15/0822 399/263 |
| 2007/0196135 | A1 | 8/2007 | Fukuta | |
| 2008/0247784 | A1 | 10/2008 | Kakuta et al. | |
| 2010/0196059 | A1 * | 8/2010 | Maeshima | G03G 15/0868 399/263 |
| 2011/0103843 | A1 * | 5/2011 | Sato | G03G 15/0812 399/254 |
| 2011/0158669 | A1 | 6/2011 | Kayahara | |
| 2011/0286769 | A1 | 11/2011 | Mihara et al. | |
| 2014/0086638 | A1 * | 3/2014 | Sato | G03G 15/0812 399/252 |
| 2016/0306294 | A1 * | 10/2016 | Nagura | G03G 15/0887 |

FOREIGN PATENT DOCUMENTS

| | | | |
|---|---|---|---|
| JP | H08-30084 | A | 2/1996 |
| JP | 2002-236410 | A | 8/2002 |
| JP | 2003-156927 | A | 5/2003 |
| JP | 2005-084072 | A | 3/2005 |
| JP | 2006-251114 | A | 9/2006 |
| JP | 2010-032754 | A | 2/2010 |
| JP | 2012-063799 | A | 3/2012 |

* cited by examiner

DEVELOPER CONVEYING APPARATUS AND DEVELOPING APPARATUS

BACKGROUND OF THE INVENTION

Field of the Invention

The present invention relates to a developer conveying apparatus capable of conveying and providing developer with a simple configuration.

Description of the Related Art

In the past, in a case where a developer is used and consumed in an electrophotographic image forming apparatus, a developer replenish method for replenishing new developer is used. A method for replenishing developer (toner) by exchanging a developer replenish container such as a toner bottle that is detachably attachable to an electrophotographic image forming apparatus is used as a developer replenish method. A toner replenished from the developer replenish container is conveyed in a developing apparatus.

For example, Japanese Patent Laid-Open No. H8-30084 describes a developer conveying apparatus in which two agitation and conveying members attached with spiral members around the rotation axes are arranged side by side so as not to accumulate, in an uneven manner in the developing apparatus, a toner that is not consumed and is degraded and accordingly has a low level of charging amount, and a circulation path for the developer is formed over the entire width of the developing apparatus.

Japanese Patent Laid-Open No. 2010-32754 describes a developer conveying apparatus that always maintains, at a regular direction, a deformation direction of a tongue shape formed on a rotation agitation vane of an agitation member conveying toner in a toner containing portion to a toner providing portion.

However, the developer conveying apparatus described in Japanese Patent Laid-Open No. H8-30084 is provided with the two spiral rotation members, and therefore, it is necessary to provide a structure for driving rotation of each of them, and there is a problem in that this results in a more complicated, larger, and higher-cost apparatus.

The developer conveying apparatus described in Japanese Patent Laid-Open No. 2010-32754 agitates and conveys the toner remaining in the container inner end portion by gathering the remaining toner to the container central portion, but the developer conveying apparatus described in Japanese Patent Laid-Open No. 2010-32754 is unable to agitate and convey the toner from the container central portion to the container end portion side, and therefore, there is a problem in that the agitation and conveying are insufficient, and which makes it impossible to obtain an image without unevenness in the lightness and darkness.

SUMMARY OF THE INVENTION

According to the present invention, there is provided a developer conveying apparatus for conveying a developer that develops an electrostatic latent image, and the developer conveying apparatus includes a rotation unit which rotates around a rotation shaft parallel to a developer conveying direction, a first developer conveying portion which is provided in the rotation unit and which conveys the developer in an axial direction of the rotation shaft, and a second developer conveying portion which is provided in the rotation unit at a position where a distance from the rotation shaft is different from that of the first developer conveying portion, and which conveys the developer in a direction opposite to that of the first developer conveying portion.

Further features of the present invention will become apparent from the following description of exemplary embodiments with reference to the attached drawings.

DESCRIPTION OF THE EMBODIMENTS

First Embodiment

Figure 1:
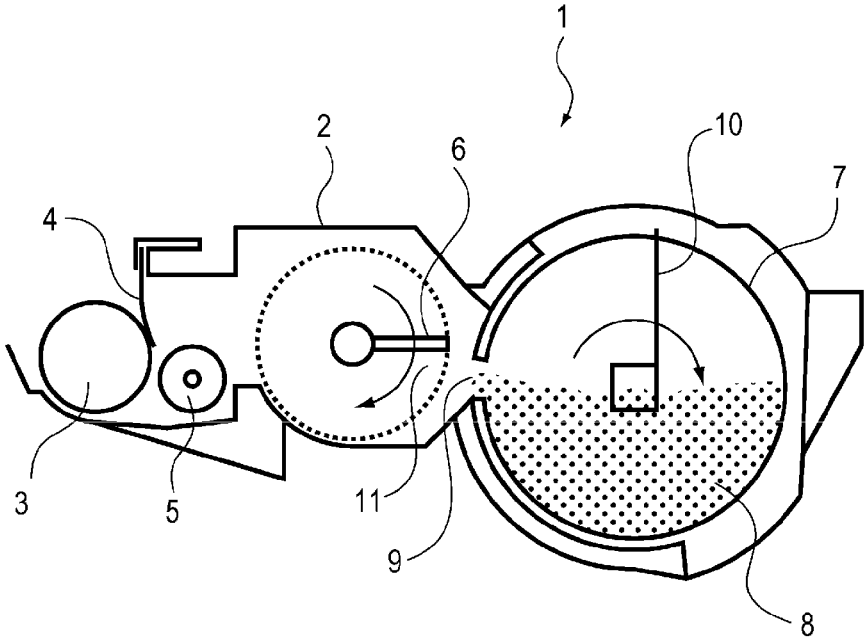
FIG. 1 is a schematic view illustrating a developing apparatus according to the present invention.

FIG. 1 is a schematic view illustrating a developing apparatus 1 including a developer conveying apparatus according to the present invention.

The developing apparatus 1 is a developing apparatus used for an image forming apparatus such as a copy machine, a printer, or a facsimile employing an electrophotographic method and the like. The developer container 2 serving as a developer containing portion includes a developing roller 3 serving as a developer bearing member carrying a developer for visualizing an electrostatic latent image formed on a photosensitive drum surface serving as an image bearing member, not shown. The developing apparatus 1 includes a developing blade 4 for charging the toner 8 serving as the developer and limiting the toner layer formed on the surface of the developing roller 3 and a toner conveying member 5 for providing the toner 8 to the developing roller 3. Further, as a member for agitating and conveying the developer in the developer containing portion, the developer container 2 is provided with a developer conveying apparatus 6 for agitating, providing, and conveying the toner 8 to the toner conveying member 5.

The toner bottle 7 is a developer replenish container that is detachably attachable to the developer container 2, and the magnetic single component toner 8 is accommodated in the developer replenish container, and the toner bottle 7 has a toner replenishing port 9 which is an opening through which the toner 8 is replenished to the developer container 2. The toner bottle 7 includes an agitation member 10 capable of rotating therein. The agitation member 10 provides the toner 8 in the toner bottle 7 via the toner replenishing port 9 to the developer container 2. The provided toner 8 is guided to a facing area 11 facing the toner replenishing port 9 in the developer conveying apparatus 6.

Figure 2:
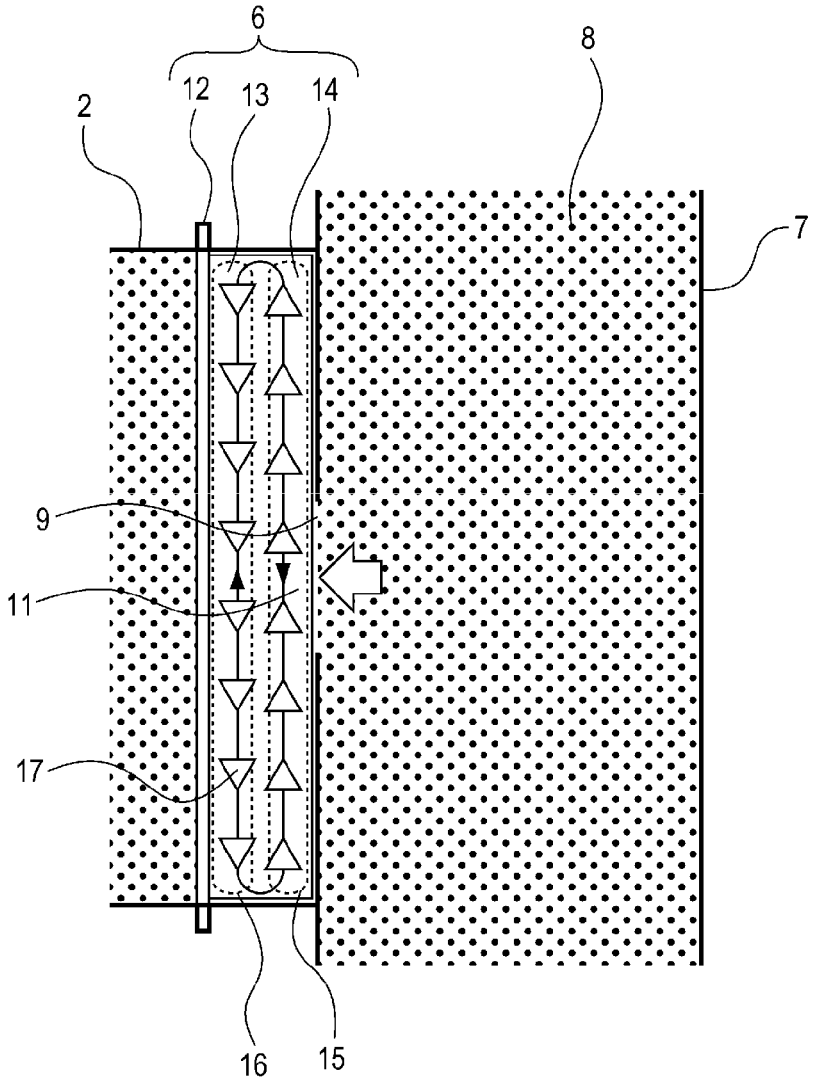
FIG. 2 is a diagram for describing multiple developer conveying units provided in an agitation and conveying member.

FIG. 2 is a diagram for describing multiple developer conveying units provided in the developer conveying apparatus 6, and is a diagram illustrating, seen from above, an inside of a configuration in which the toner bottle 7 is attached to the developer container 2 so that the toner replenishing port 9 and the facing area 11 of the developer conveying apparatus 6 can face each other.

The developer conveying apparatus 6 includes a rotation shaft 12 extending along the same direction as the rotation shaft direction of the developing roller 3, and a rotation unit 14 including a conveying surface 13 having a side in a direction perpendicular to the rotation shaft 12 and a side in the axial direction of the rotation shaft 12. The rotation unit 14 is constituted by a sheet or a plate-like thin plate having flexibility, and is provided to be able to rotate about the rotation shaft 12 in the developer container 2 serving as the developer containing portion.

Below the rotation shaft 12 of the developer conveying apparatus 6, the developer container 2 accumulates the toner 8 conveyed from the toner replenishing port 9 to the toner conveying member 5. It should be noted that the conveying surface 13 of the rotation unit 14 is provided with multiple developer conveying units rotating about the rotation shaft 12 from the toner replenishing port 9 via the lower side of the inside of the developer container 2 to the toner conveying member 5, thereby conveying and moving the toner along the axial direction of the rotation shaft 12. The developer conveying unit includes a first developer conveying portion 15 provided on the conveying surface 13 and extending along the axial direction of the rotation shaft 12 and a second developer conveying portion 16 provided on the rotation unit 14 at a position of which distance from the rotation shaft 12 is different from that of the first developer conveying portion 15. The first developer conveying portion 15 is provided together at the side of the rotation end in the rotation radius direction of the rotation shaft 12 with respect to the second developer conveying portion 16.

In this case, the conveying direction of the toner 8 with the first developer conveying portion 15 and the conveying direction of the toner 8 with the second developer conveying portion 16 are configured to be opposite from each other with respect to the axial direction of the rotation shaft 12. The developer conveying portions 15, 16 of which conveying direction are in the directions opposite to each other form the toner conveying paths on the surface of the conveying surface 13 according to the rotation of the developer conveying apparatus 6. The toner 8 conveyed to one end side in the axial direction of the rotation shaft 12 by the first developer conveying portion 15 along the surface of the conveying surface 13 is then conveyed so as to circulate toward the end portion side at the opposite side by the second developer conveying portion 16.

Therefore, the toner 8 can be agitated so as to prevent the toner 8 from being accumulated at the end portion of the developer container 2 and uniformize the toner 8.

On the first developer conveying portion 15 and the second developer conveying portion 16, multiple opening portions 17 in a predetermined shape described below are arranged in rows on the developer conveying surface 13 of the rotation unit.

The opening portion 17 has such a shape that the size of the opening (opening width) becomes larger in a direction perpendicular to the toner conveying direction along the axial direction. When the conveying surface 13 rotates about the axis of the rotation shaft 12, and the toner 8 pushed and moved by the conveying surface 13 passes through the opening portion 17 from the front side to the back side of the conveying surface 13 (the forward side to the backward side in the rotation direction), the toner 8 moves from the side where the opening width of the opening portion 17 is smaller to the side where the opening width of the opening portion 17 is larger. With this movement of the toner 8, the toner conveying operation is performed in the predetermined direction. This is because the toner 8 is pushed and moved by the conveying surface 13 in a direction in which the pressure given by the toner 8 to the rotating conveying surface 13 decreases, and more specifically, the toner 8 is pushed and moved by the conveying surface 13 in a direction in which the opening width becomes larger, so that the toner conveying operation is performed in the predetermined direction as described above.

Figure 3:
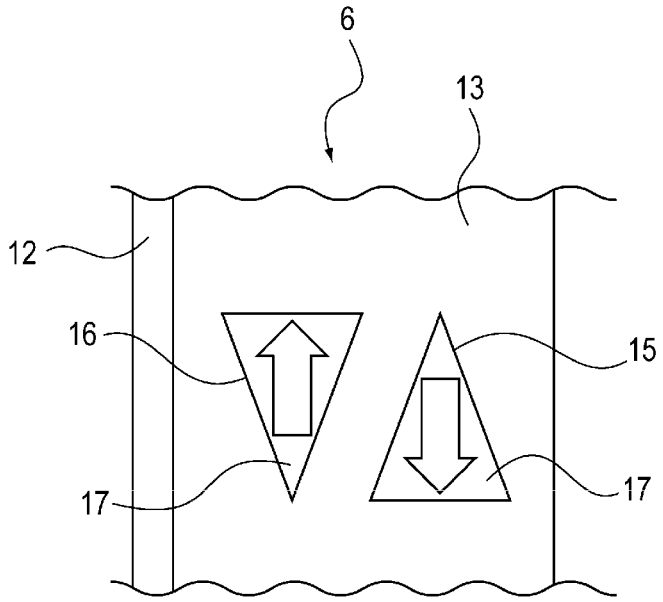
FIG. 3 is an example of opening portions formed in a conveying surface of a rotation unit.

FIG. 3 is an example of opening portions 17 serving as developer conveying units formed in the conveying surface 13 of the rotation unit 14.

The opening portion 17 is in such a shape that the vertex of the triangle is in a direction opposite to the direction in which the toner 8 is conveyed so that the opening width increases so as to reduce the pressure of the toner 8 received by the conveying surface 13. Therefore, the direction of the vertexes of the triangles of the multiple opening portions 17 of the first developer conveying portion 15 and the direction of the vertexes of the triangles of the multiple opening portions 17 of the second developer conveying portion 16 are in a relationship opposite to each other.

Figure 4:
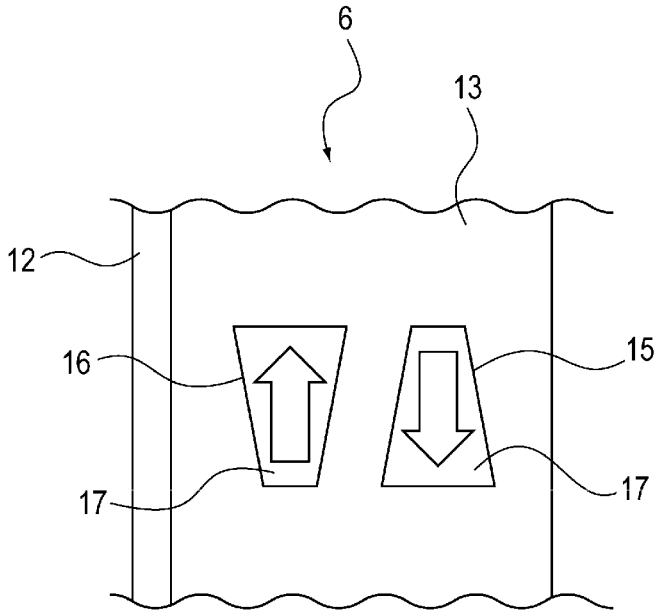
FIG. 4 is another example of opening portions formed in the conveying surface of the rotation unit.

FIG. 4 is another example of opening portions 17 formed in the conveying surface 13 of the rotation unit 14.

The shapes of the opening portions 17 formed in the conveying surface 13 of the rotation unit 14 may be in such a shape to cause the toner 8 to move as described above in accordance with the rotation of the developer conveying apparatus 6 in the developer container 2, and in this case, an example where the shape of the opening portion 17 is a trapezoid will be described. This opening portion 17 arranges the trapezoid shape in the conveying surface 13 so that the size of the opening (opening width) becomes larger in the direction in which the toner 8 is to be conveyed. More specifically, the opening portions 17 in the trapezoid shape are provided, in place of the triangle opening portions 17 of the two developer conveying portions 15, 16 of FIG. 2, so that the upper base and the lower base of the trapezoid are positioned in the direction in which the toner 8 is to be conveyed, and the same agitation and conveying effects of the toner 8 are achieved.

Figure 5:
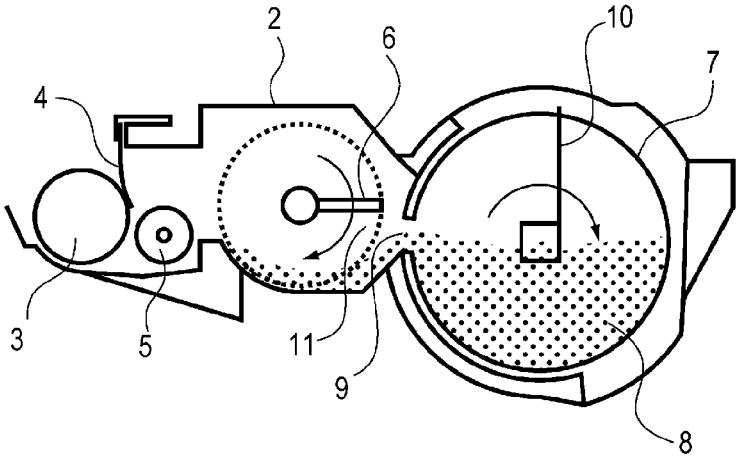
FIG. 5 is a diagram illustrating an initial state in which toner is replenished from a toner bottle to a developer container.
Figure 5:
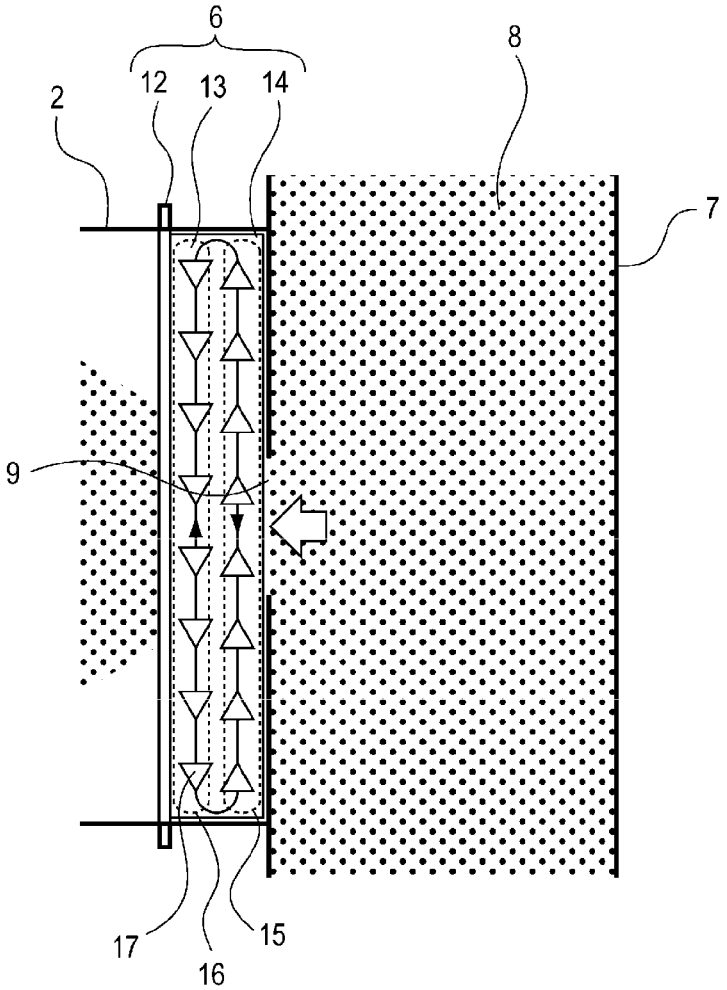
Figure 6:
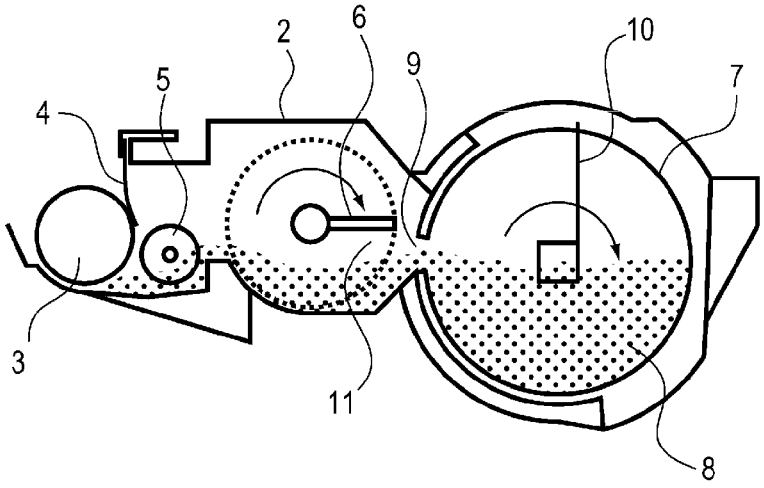
FIG. 6 is a diagram illustrating a state in which toner is replenished from the toner bottle to the developer container.
Figure 6:
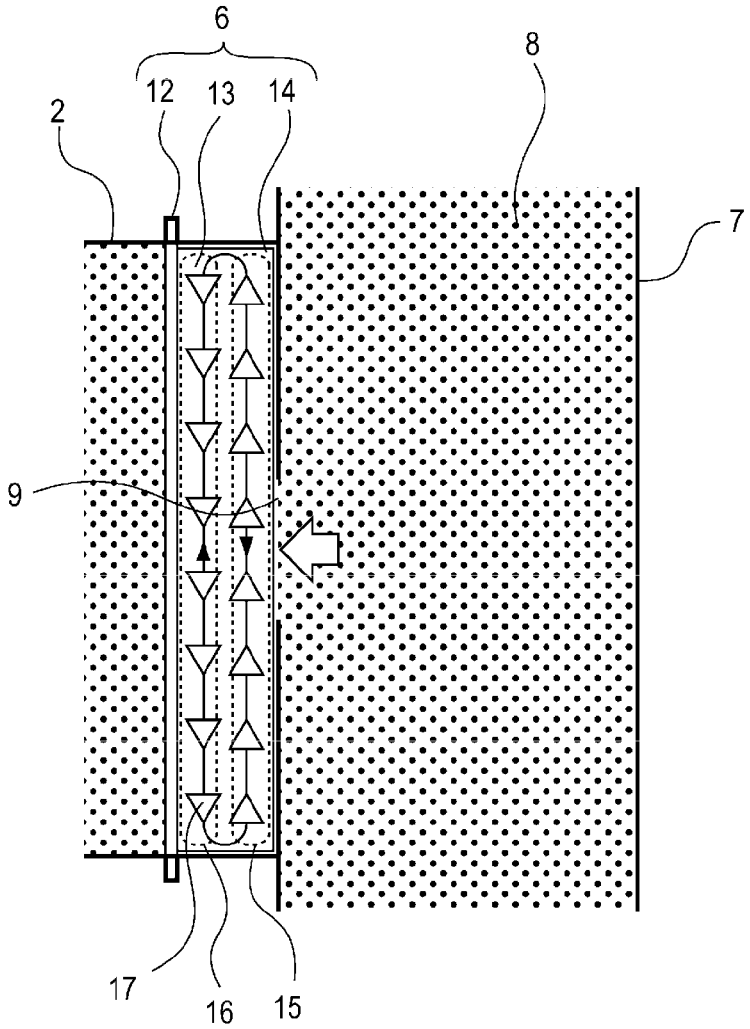

FIGS. 5 and 6 are diagrams illustrating an initial state in which the toner 8 is replenished from the toner bottle 7 to the developer container 2.

In the initial state in which the toner 8 is replenished from the toner replenishing port 9 of the toner bottle 7 to the facing area 11 of the conveying surface 13, the developer conveying apparatus 6 rotates so as to convey and provide, with the rotation end side in the rotation radius direction of the conveying surface 13 of the rotation unit 14, the toner 8 to the toner conveying member 5. At this occasion, the first developer conveying portion 15 also conveys the toner 8 in a direction along the axial direction of the rotation shaft 12 of the developer conveying apparatus 6. In this case, the axial direction of the rotation shaft 12 of the developer conveying apparatus 6 is also a direction along the longitudinal direction of the developer container 2. The longitudinal direction of the developer container 2 is also a direction along the rotation shaft direction of the developing roller 3.

Figure 7:
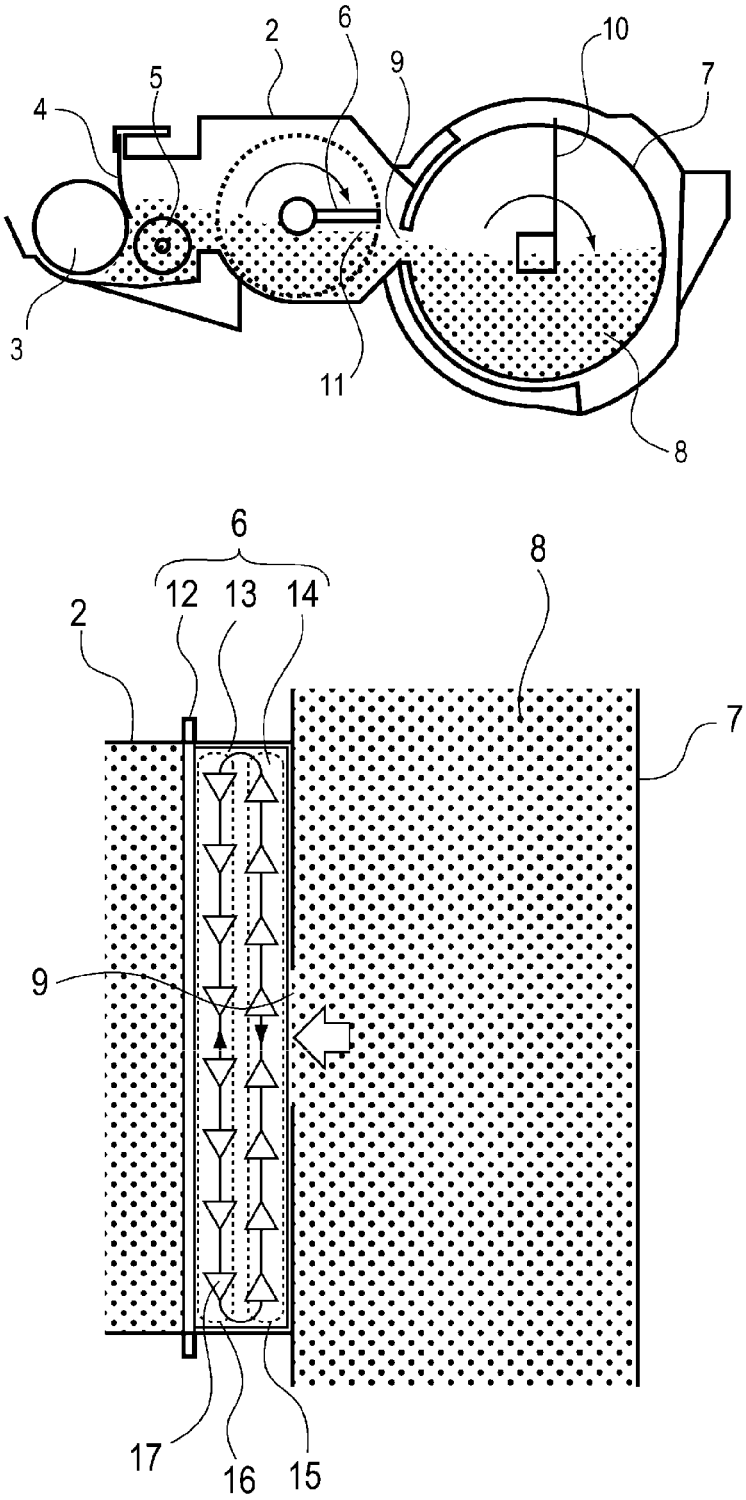
FIG. 7 is a diagram illustrating a state in which the toner provided from the toner bottle is conveyed by a first developer conveying unit and a second developer conveying unit of an agitation and conveying member.

FIG. 7 is a diagram illustrating a state in which the toner 8 provided from the toner bottle 7 is conveyed by the conveying surface 13 of the rotation unit 14 and the first developer conveying portion 15 and the second developer conveying portion 16 formed in the conveying surface 13.

When the toner 8 is replenished from the toner replenishing port 9 to the facing area 11, and there is an increase in the amount of the toner in the area where there exists the facing area 11, the developer conveying apparatus 6 rotating in the developer container 2 conveys the toner 8 in the facing area 11 to the toner conveying member 5. Together with this, the toner 8 is moved by the first developer conveying portion 15 and the second developer conveying portion 16 along the longitudinal direction of the developer container 2 in the conveying direction of each of the developer conveying portions 15, 16. When the toner 8 is moved and conveyed by these two developer conveying portions 15, 16, the toner 8 in the developer container 2 is sufficiently agitated, and it is confirmed that the uniformity state along the longitudinal direction of the developer container 2 is more uniformized than the state of a developer container available until then.

Subsequently, another example of a configuration formed with the conveying surface 13 of the rotation unit 14 for achieving conveying of the toner 8 along the axial direction of the rotation shaft 12 will be described.

FIGS. 8A to 8D are explanatory diagrams illustrating cut portions 18 formed in the conveying surface 13 of the rotation unit 14.

Figure 8A:
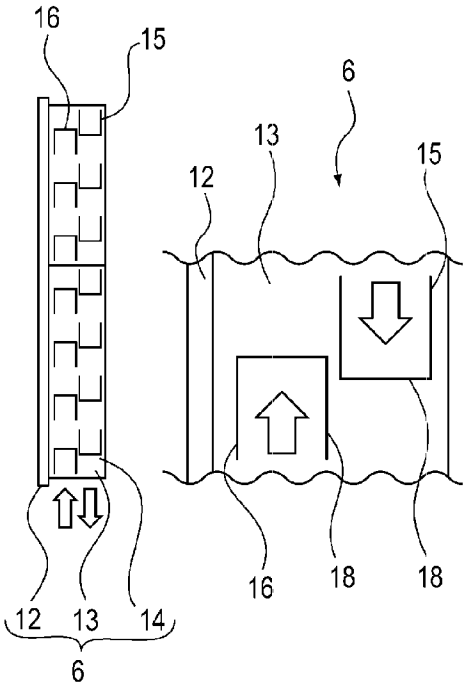
FIGS. 8A to 8D are explanatory diagrams illustrating cutting portions formed in the conveying surface of the rotation unit.

The two developer conveying portions 15, 16 are formed with tongue-shaped cut portions 18 that are formed with openings bent to the backward side in the rotation direction in which the developer conveying apparatus 6 rotates about the rotation shaft 12 in a direction in which the toner 8 is to be conveyed (FIG. 8A). The cut portion 18 is in such a shape that, in accordance with the rotation of the developer conveying apparatus 6, the toner 8 moves from the side where there is no cutting to the deformation piece forward-end side of the cut portion 18 by the pressure given by the toner 8 and received by the conveying surface 13 of the rotation unit 14. When the pressure given by the toner 8 is applied to the conveying surface 13, the toner 8 moves in the direction in which the opening is formed in the cut portion 18, so that the toner 8 is conveyed in each of the predetermined directions.

Figure 8B:
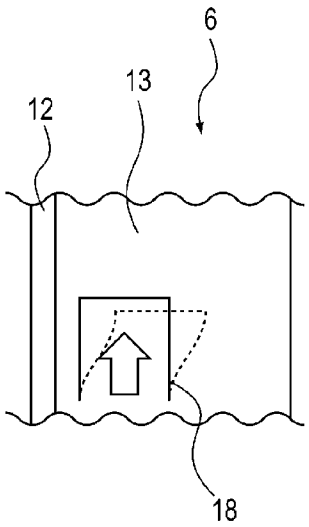
Figure 8C:
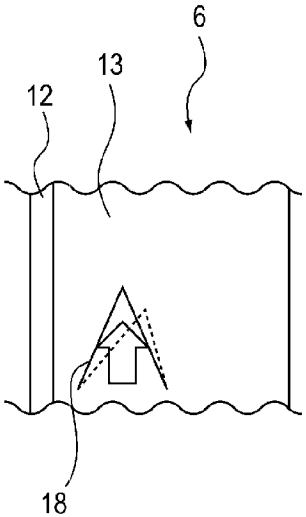
Figure 8D:
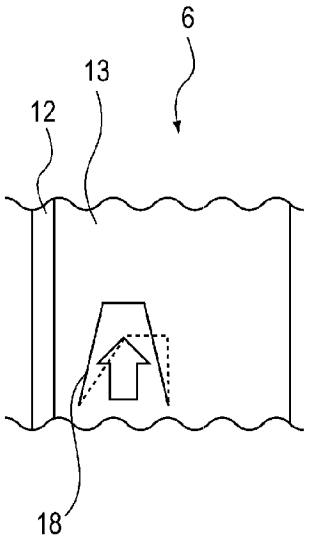

The opening formed in the cut portion 18 may be in a C-shape shape, a triangular shape, or may be in a trapezoid shape (FIGS. 8B, 8C, 8D). In the case of the C-shape shape cutting, the pressure of the toner 8 bends the cut portion 18 from the side where there is no cutting to the opposite side where a cutting is made. As described above, the toner 8 moves to the bent cut portion 18, so that the toner 8 can be conveyed.

In the case of the triangular shape cutting, the cutting is formed from the base of the triangle toward the vertex side so as to allow the cut portion 18 to be bent easily by the pressure of the toner 8, whereby the toner 8 is conveyed in that direction.

In the case of the trapezoid shape cutting, a cutting is formed from the lower base side to the upper base side due to the same reason, and accordingly, the toner 8 is conveyed in that direction. The trapezoid shape has a larger number of sides than the case of the triangular shape, and therefore, the size of the opening (opening width) in a direction perpendicular to the toner conveying direction can be easily adjusted, so that the amount of toner conveyed can be easily adjusted.

In the above embodiment, each of the opening portion 17 and the cut portion 18 formed in the two developer conveying portions 15, 16 is made to have substantially the same size, so that the conveying force is configured to be about the same level. However, the amount of toner 8 conveyed can be set to any amount by appropriately selecting the size of each portion such as the sides of the shape of the opening portion 17, or the cut direction of the cut portion 18 and the size of each portion of the shape.

Second Embodiment

Figure 9:
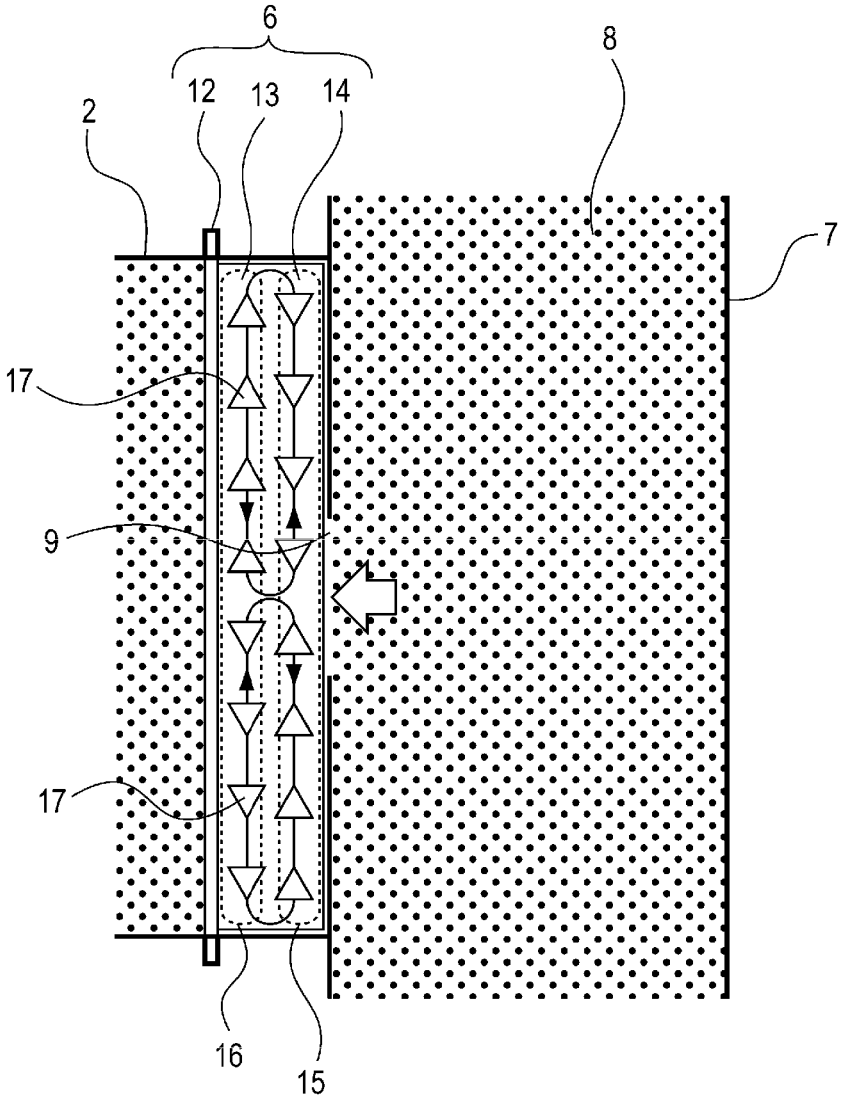
FIG. 9 is a diagram for describing a second embodiment according to the present invention.

FIG. 9 is a diagram for describing the second embodiment according to the present invention.

In this case, the first developer conveying portion 15 and the second developer conveying portion 16 are configured so that the direction in which the developer is conveyed is inverted in such a manner that the facing area 11 of the conveying surface 13 of the rotation unit 14, which faces the toner replenishing port 9, is the border.

The first developer conveying portion 15 conveys the developer from the facing area 11 that faces the toner replenishing port 9 toward the end portion in the axial direction of the rotation shaft 12, and the second developer conveying portion 16 arranged on the rotation unit 14 at a position of which distance from the rotation shaft 12 is different from the first developer conveying portion 15 conveys the developer from the end portion in the axial direction of the rotation shaft 12 toward the facing area 11.

The first developer conveying portion 15 and the second developer conveying portion 16 are provided so that the new toner 8 replenished from the toner bottle 7 to the facing area 11 is conveyed from the facing area 11 to both end sides in the axial direction of the rotation shaft 12 of the developer conveying apparatus 6, and thereafter returned back to the facing area 11.

The conveying surface 13 of the rotation unit 14 of the developer conveying apparatus 6 is formed with the opening portions 17 and the cut portions 18 in such a shape that the first developer conveying portion 15 conveys the toner 8 to both end sides of the axial direction of the rotation shaft 12 in such a manner that the facing area 11, which faces the toner replenishing port 9, is the border. Further, the conveying surface 13 at the side of the rotation shaft 12 of the first developer conveying portion 15 (at the side of the rotation center) is formed with the opening portions 17 and the cut portions 18 in such a shape that the second developer conveying portion 16 returns the toner 8, which has been conveyed to the end portion by the first developer conveying portion 15, back to the facing area 11.

According to this configuration, the circulation path is changed to the half, and therefore, the toner 8 provided from the toner replenishing port 9 by the second developer conveying portion 16 can be conveyed to the both end sides in the axial direction of the rotation shaft 12 in a short time, and the first developer conveying portion 15 can convey the toner 8 to the center side in the axial direction of the rotation shaft 12 in a short time. For this reason, the toner 8 in the developer container 2 can be agitated in a shorter time, and further, the toner 8 can be conveyed so as to be expanded to all of the inside of the developer container 2 without accumulating the toner 8 at the end portion of the developer container 2. In particular, the toner 8 can be expanded and conveyed to all the inside of the developer container 2 without accumulating the toner 8 at the rotation end side of the rotation unit 14, and the toner 8 in the developer container 2 can be uniformized.

Figure 10:
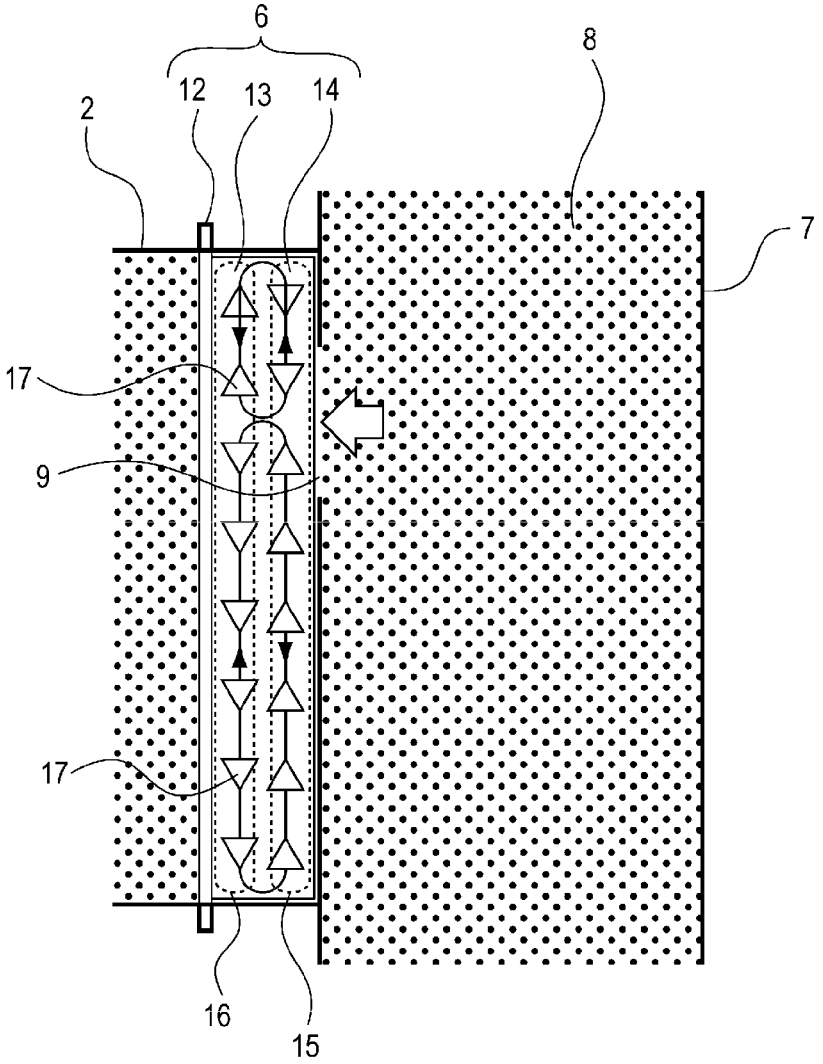
FIG. 10 is a diagram for describing a case where a toner replenishing port is not located in the center in an axial direction of a rotation shaft of the agitation and conveying member.

As shown in FIG. 10, even in a case where the toner replenishing port 9 is not positioned around the center in the axial direction of the rotation shaft 12 of the developer conveying apparatus 6 due to the relationship of arrangement of the entire apparatus, the configuration of the present embodiment can be applied. The configuration of the two developer conveying portions 15, 16 described above may be formed in the conveying surface 13 in such a manner that the facing area 11 facing the toner replenishing port 9 is the border described above, so that the same effects as those provided by each of the developer conveying portions 15, 16 can be obtained.

Third Embodiment

Figure 11:
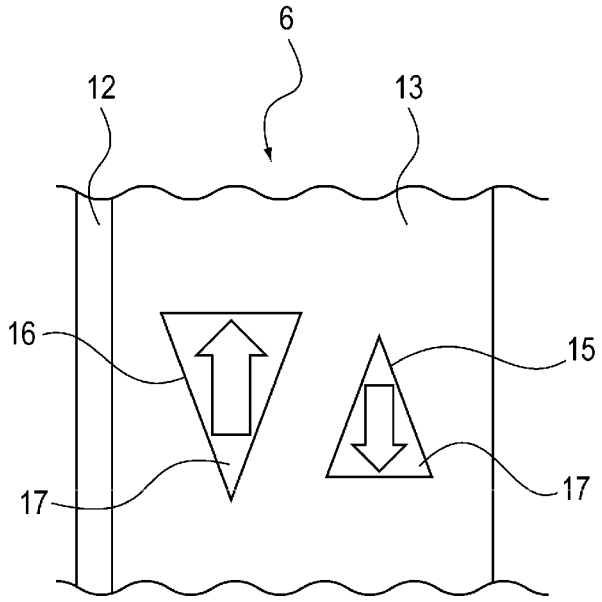
FIG. 11 is a diagram for describing a third embodiment according to the present invention.

FIG. 11 is a diagram for describing the third embodiment of the present invention.

In this case, a difference is generated between the amount of toner conveyed in the axial direction of the rotation shaft 12 by the first developer conveying portion 15 and the amount of toner conveyed in the axial direction of the rotation shaft 12 by the second developer conveying portion 16. More specifically, the amount of toner conveyed to the developing roller 3 by the rotation of the rotation unit 14 is larger in the area of the conveying surface 13 where the first developer conveying portion 15 is provided than in the area of the conveying surface 13 where the second developer conveying portion 16 is provided.

It should be noted that the developer conveying apparatus 6 can be applied to the present embodiment even with two developer conveying portions 15, 16 of various forms according to the first embodiment and the second embodiment. For example, not only the shape as shown in FIG. 3 but also the shape as shown in FIG. 4 and FIGS. 8A to 8D may be used as the shape of the opening portion 17 and the cut portion 18, as long as the shape is a shape that satisfies the relationship of the predetermined toner conveying direction, the opening width, or the amount of cutting. The arrangements as shown in FIG. 2, FIG. 9, and FIG. 10 may be used as the arrangement of the opening portions 17 and the cut portions 18 of the two developer conveying portions 15, 16.

The size of the opening portion 17 or the cut portion 18 of the first developer conveying portion 15 according to the present embodiment is smaller than the opening portion 17 or the cut portion 18 of the second developer conveying unit portion. According to this configuration, the amount of toner conveyed in the axial direction of the rotation shaft 12 by the first developer conveying portion 15 is smaller than the amount of toner conveyed in the axial direction by the second developer conveying portion 16. More specifically, the amount of the toner 8 that passes through the opening portion 17 or the cut portion 18 of the first developer conveying portion 15 and passes from the front side to the back side of the conveying surface 13 is smaller than the second developer conveying portion 16.

According to this configuration, while the toner 8 in the developer container 2 is sufficiently agitated, the amount of the toner 8 conveyed in the direction of the toner conveying member 5 and the developing roller 3 which is a direction perpendicular to the rotation shaft 12 is larger at the rotation end side in the rotation radius direction of the rotation shaft 12 of the rotation unit 14 of the developer conveying apparatus 6 than at a side closer to the rotation shaft 12 of the rotation unit 14 of the developer conveying apparatus 6. For this reason, the toner 8 can be easily and stably provided to the developing roller 3.

Fourth Embodiment

Figure 12:
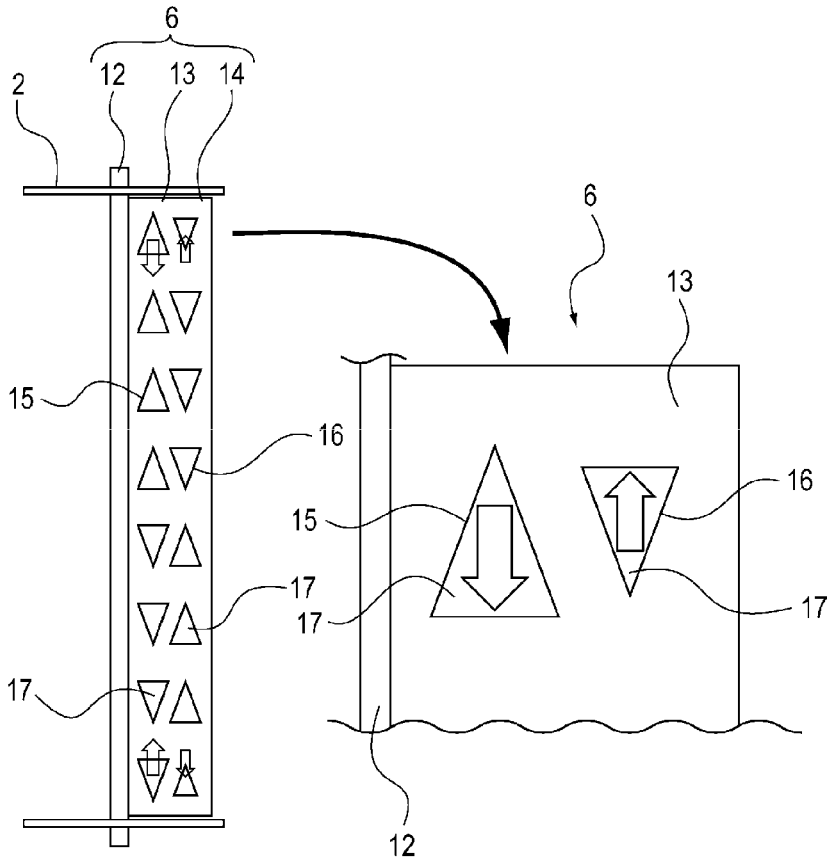
FIG. 12 is a diagram for describing a fourth embodiment according to the present invention.
Figure 13:
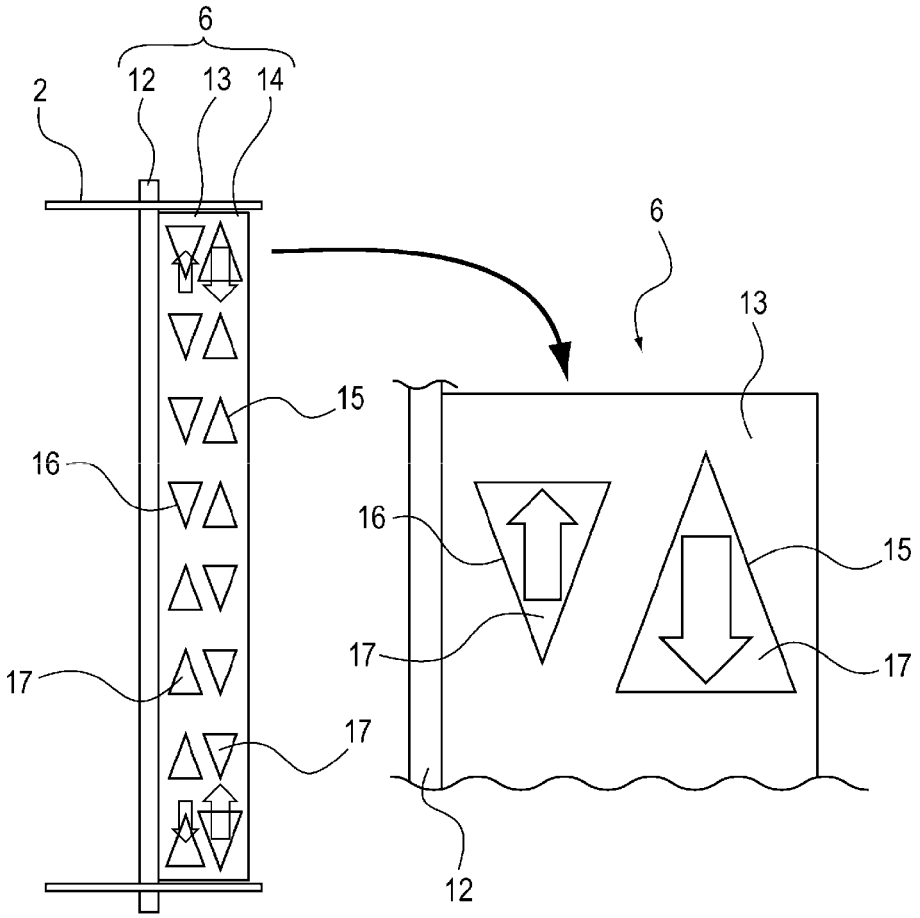
FIG. 13 is a diagram for describing the fourth embodiment according to the present invention.

FIG. 12 and FIG. 13 are diagrams for describing the fourth embodiment according to the present invention.

In this case, the amount of the developer conveyed in the axial direction of the rotation shaft by the developer conveying portions 15, 16 is such that, on the conveying surface 13, around the end portion in the axial direction, the amount of the developer conveyed from the axial direction central portion to the end portion is configured to be smaller than the amount of the developer conveyed from the end portion to the central portion.

It should be noted that, except around the end portion, the developer conveying apparatus 6 may be the same one as the two developer conveying portions 15, 16 according to various forms according to the first embodiment, the second embodiment, and the third embodiment.

In addition to these various forms, further, the present embodiment employs a configuration in which the amounts of toners conveyed at the end portion in the axial direction of the rotation shaft 12 of the two developer conveying portions 15, 16 are configured to be different between both of the developer conveying units. This is an effect that is obtained by using the fact that the amount of toner conveyed increases when the size of the opening portion 17 and the cut portion 18 is increased, or the amount of toner conveyed decreases when the size of the opening portion 17 and the cut portion 18 is decreased.

In the configuration of FIG. 12, the opening portion 17 of the first developer conveying portion 15 at the end portion in the axial direction of the rotation shaft 12 of the developer conveying apparatus 6 is smaller than the opening portion 17 of the second developer conveying portion 16. According to this configuration, the amount of toner conveyed can be differentiated in the conveying direction of each of the two developer conveying portions 15, 16 in the end portion area. In addition, the amount of the toner 8 conveyed to the inner wall of the developer container 2 at the axial direction end portion can be reduced, and the amount of the toner 8 accumulated in proximity to the wall can be suppressed.

In the configuration of FIG. 13, the opening portion 17 of the first developer conveying portion 15 at the end portion in the axial direction of the rotation shaft 12 of the developer conveying apparatus 6 is larger than the opening portion 17 of the second developer conveying portion 16. According to this configuration, a difference can be generated in the amount of toner conveyed in the conveying direction of each of the two developer conveying portions 15, 16 at the end portion area. The amount of the toner 8 conveyed from the axial direction end portion to the central portion (at the side of the center of the developer container 2) can be increased, and the amount of the toner 8 accumulated in proximity to the inner wall of the developer container 2 can be suppressed.

Further, by combining the configuration of FIG. 12 and the configuration of FIG. 13, the effect can be enhanced. More specifically, the opening portions 17 at the axial direction end portions of the second developer conveying portion 16 are smaller than the opening portions 17 other than those at the end portions of the first developer conveying portion 15, and the opening portions 17 at the axial direction end portions of the first developer conveying portion 15 are larger than the opening portions 17 other than those at the end portions of the second developer conveying portion 16. According to this configuration, while the force for pressing the toner 8 onto the inner wall is suppressed, the amount of the toner 8 returned back to the central portion can be increased, and therefore, the amount of the toner 8 accumulated in proximity to the inner wall of the developer container 2 can be suppressed, and the toner 8 can be sufficiently agitated.

Figure 14:
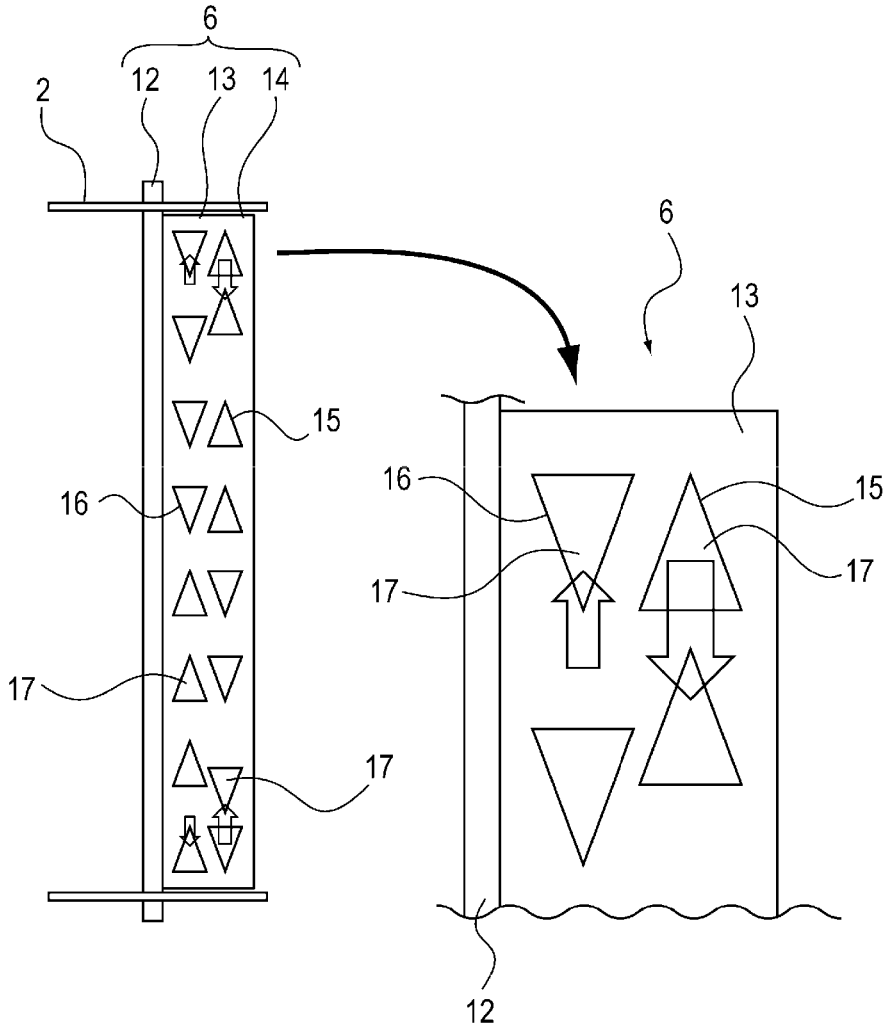
FIG. 14 is a diagram for describing still another example of the fourth embodiment according to the present invention.
Figure 15:
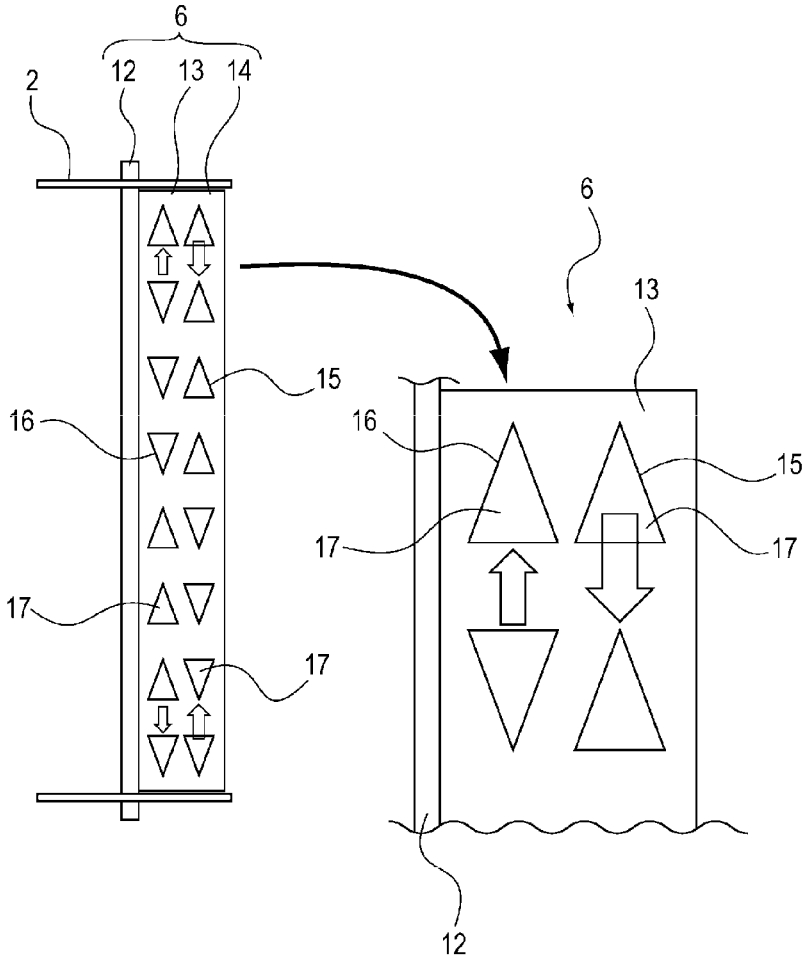
FIG. 15 is a diagram for describing still another example of the fourth embodiment according to the present invention.

FIG. 14 and FIG. 15 are diagrams for describing still another example of the present embodiment.

As shown in FIG. 14, at the end portions in the axial direction of the rotation shaft 12 of the developer conveying apparatus 6, the interval of the arrangement of the opening portions 17 of the second developer conveying portion 16 is formed to be larger than the interval of the arrangement of the opening portions 17 of the first developer conveying portion 15. When the interval of the arrangement increases, the amount of toner conveyed there can be reduced.

As shown in FIG. 15, at the end portions of the second developer conveying portion 16, a configuration for conveying the toner 8 in a direction opposite to the conveying direction with the second developer conveying portion 16 is provided. In the configuration of FIG. 15, the opening portions 17 at the end portions of the second developer conveying portion 16 are formed to be in a direction opposite to the other opening portions 17 of the second developer conveying portion 16 and to be in the same direction as the opening portions 17 of the first developer conveying portion 15. When the opening portions 17 are formed in the opposite direction, the amount of toner conveyed there can be reduced.

According to such configuration, a difference can also be generated in the amount of toner conveyed in the conveying direction of each of the two developer conveying portions 15, 16 in the axial direction end portion areas of the conveying surface 13. Accordingly, like the configuration of FIG. 12 and FIG. 13, the amount of toner conveyed to the end portion side with the second developer conveying portion 16 can be configured to be more than the amount of toner conveyed to the central portion side with the first developer conveying portion 15. For this reason, the same effects as those obtained from the configuration of FIG. 12 and FIG. 13 can be obtained, i.e., the toner 8 can be sufficiently agitated by avoiding accumulating of the toner 8 at the end portions in the inside of the developer container 2.

The opening portion 17 as shown in FIG. 12 to FIG. 15 may be not only in a shape as shown in FIG. 3 but also in a shape as shown in FIG. 4 and FIGS. 8A to 8D as long as it is a shape satisfying relationship of the predetermined toner conveying direction and the opening width. The toner circulation path based on the arrangement of the opening portions 17 and the cut portions 18 of the two developer conveying portions 15, 16 may be what is shown in FIG. 2, FIG. 9, and FIG. 10.

By combining the configuration of the two developer conveying portions 15, 16 according to the third embodiment of the present embodiment, it is possible to avoid accumulation of the toner 8 in the end portions in the developer container 2 according to the third embodiment.

In each of the above embodiments, the developer conveying apparatus 6 is provided with a single rotation unit 14, but multiple rotation units 14 may be arranged around the rotation shaft so as not to overlap in the rotation direction of the rotation shaft 12.

As compared with an apparatus having a configuration according to a conventional example, a sufficient agitation state of the toner 8 which is the effect obtained in each of the above embodiments results in a smaller change in the reflection lightness and darkness between the axial direction central portion and the end portions on an image on a sheet on which the image has been formed, so that it is confirmed that this can prevent unevenness in the lightness and the darkness because of the uniform agitation.

Fifth Embodiment

Figure 16:
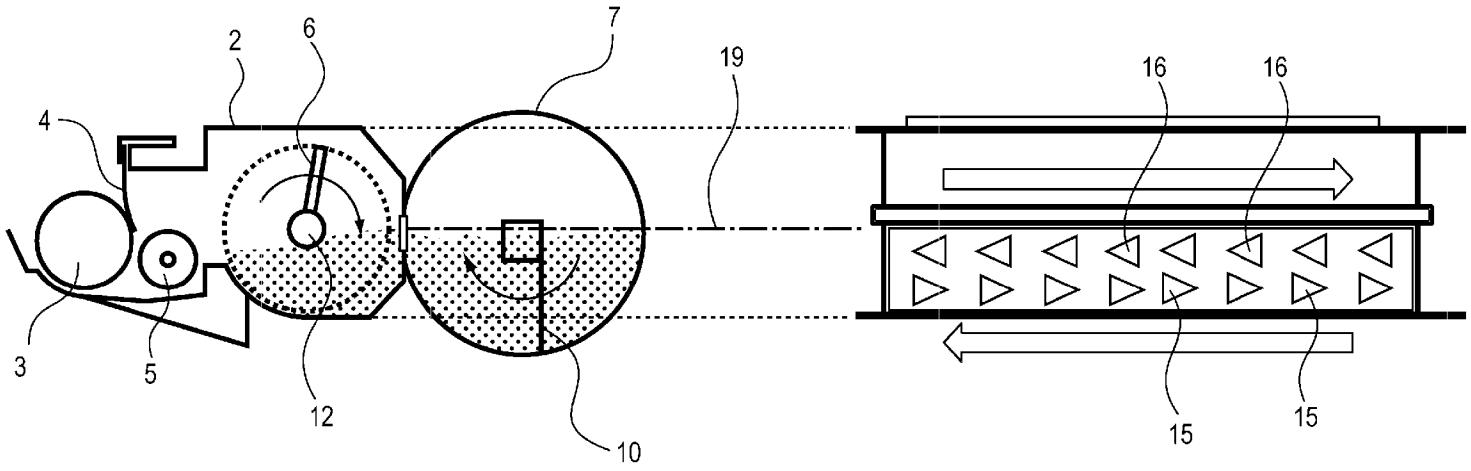
FIG. 16 is a diagram for describing a fifth embodiment according to the present invention.

FIG. 16 is a diagram for describing the fifth embodiment according to the present invention.

In this case, in order to improve the agitation efficiency with the developer conveying apparatus 6, the toner replenishing port 9 is provided as the replenish unit at a predetermined height, and the agent surface height 19 of the toner 8 accommodated in the developer container 2 which is a developer containing portion is adjusted to be the predetermined height.

Figure 17:
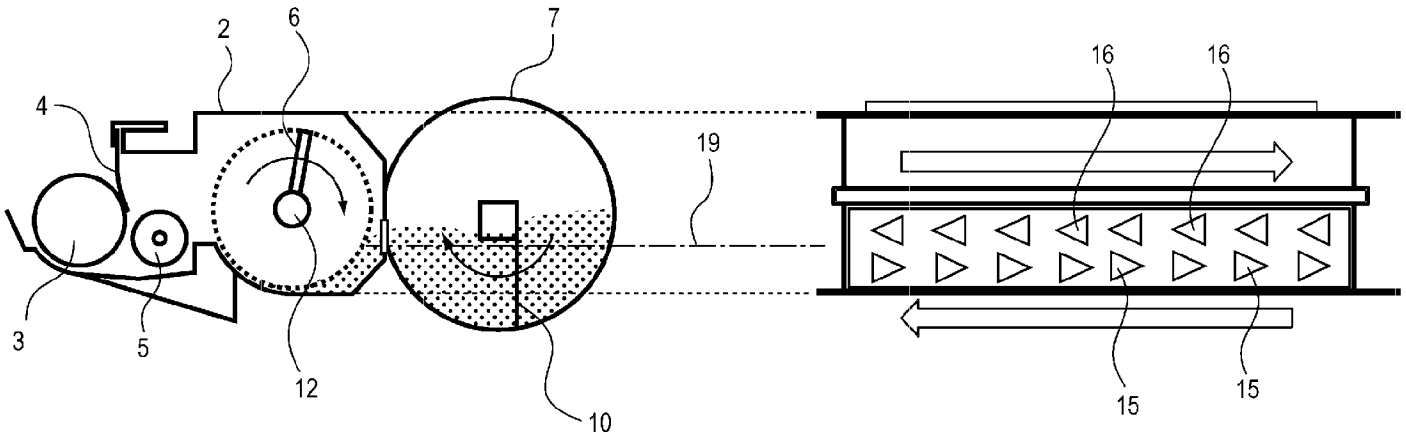
FIG. 17 is a diagram for describing a case where a toner replenishing port of the fifth embodiment according to the present invention is provided at a low position.

In the first embodiment to the fourth embodiment described above, as shown in FIG. 17, in a case where the rotation unit 14 is in a substantially vertical direction, and the agent surface height 19 of the toner 8 in the developer container 2 is below the second developer conveying portion 16 in the gravity direction, the conveying force of the second developer conveying portion 16 of the developer conveying apparatus 6 cannot be obtained in order to convey the toner in the direction of the rotation shaft 12, and the toner 8 is conveyed only in the deeper side in the longitudinal direction by the first developer conveying portion 15, and therefore, the agitation efficiency of the toner 8 in the developer container 2 may be reduced.

Figure 18:
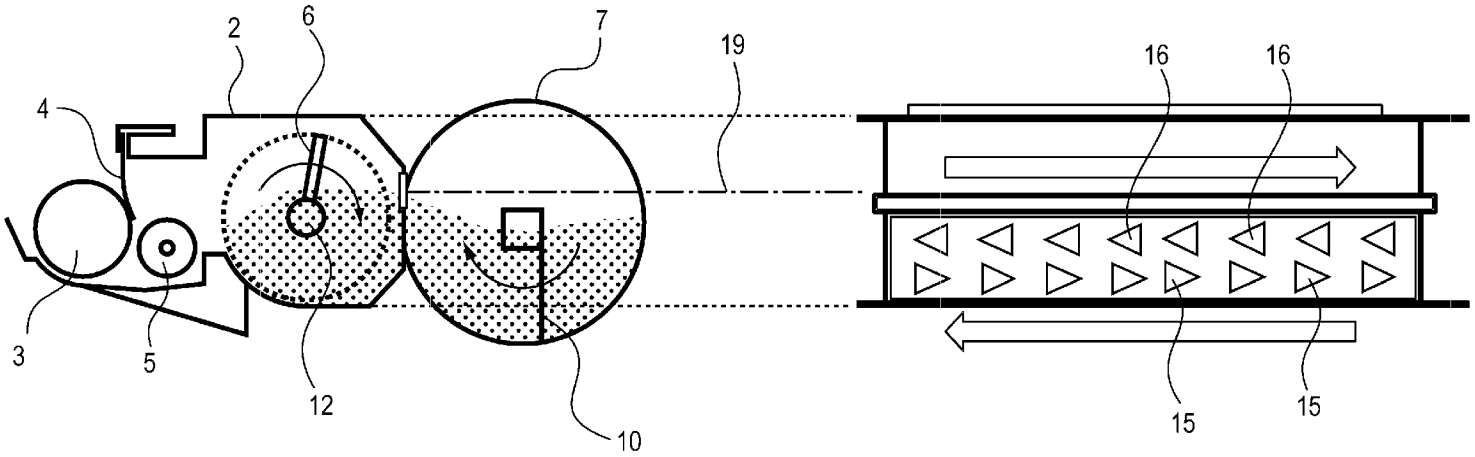
FIG. 18 is a diagram for describing a case where a toner replenishing port of the fifth embodiment according to the present invention is provided at a high position.

On the other hand, as shown in FIG. 18, in a case where the sheet member 14 is in a substantially vertical direction, and the toner agent surface height 19 in the developer container 2 is located above the proximity to the rotation shaft 12 of the developer conveying apparatus 6, the toner density in the developer container 2 increases, and the toner 8 is pressed into the proximity to the developing roller 3, and the degree of concentration of the toner increases, and therefore, uniform toner layer restriction with respect to the developing roller 3 cannot be performed.

Therefore, when the sheet member 14 is in the substantially vertical direction, the agent surface height 19 of the toner 8 in the developer container 2 is set to be equal to or more than the proximity to the upper end in the gravity direction of the second developer conveying portion 16 and equal to or less than the proximity to the rotation shaft 12 of the developer conveying apparatus 6 (hereinafter referred to as optimum position), so that this can prevent the above problem from occurring, and the agitation efficiency with the developer conveying apparatus 6 can be improved. It should be noted that the time when "sheet member 14 is in the substantially vertical direction" means a time when the sheet member 14 is below the horizontal surface and is in the substantially vertical direction.

Therefore, in the present embodiment, the toner replenishing port 9 is provided so that, when the sheet member 14 is in the substantially vertical direction, the height of the lower end of the toner replenishing port 9 is a height equal to or more than the proximity to the gravity direction upper end of the second developer conveying portion 16 and equal to or less than the proximity to the rotation shaft 12 of the developer conveying apparatus 6. Therefore, the agent surface height 19 of the toner 8 in the developer container 2 can be the optimum position.

Figure 19:
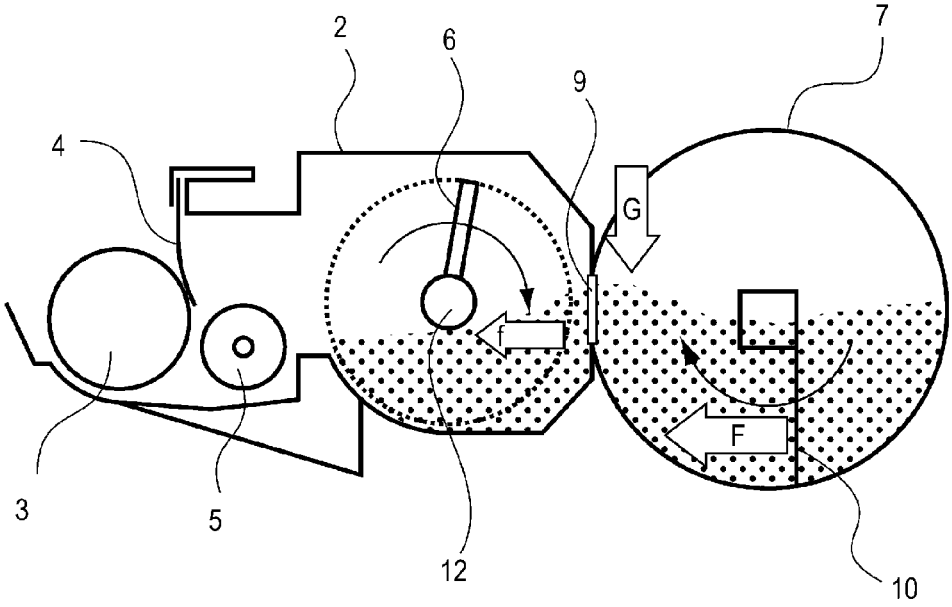
FIG. 19 is a diagram for describing the fifth embodiment according to the present invention.

Hereinafter, a relationship of the height of the toner replenishing port 9 and the agent surface height 19 of the toner 8 in the developer container 2 will be described. As shown in FIG. 19, the toner conveying force of the agitation member 10 in the toner bottle 7 is denoted as F, and the pressure given by the gravity to the toner 8 is denoted as G, and the amount of discharge from the toner bottle 7 to the developer container 2 is denoted as f.

Figure 20:
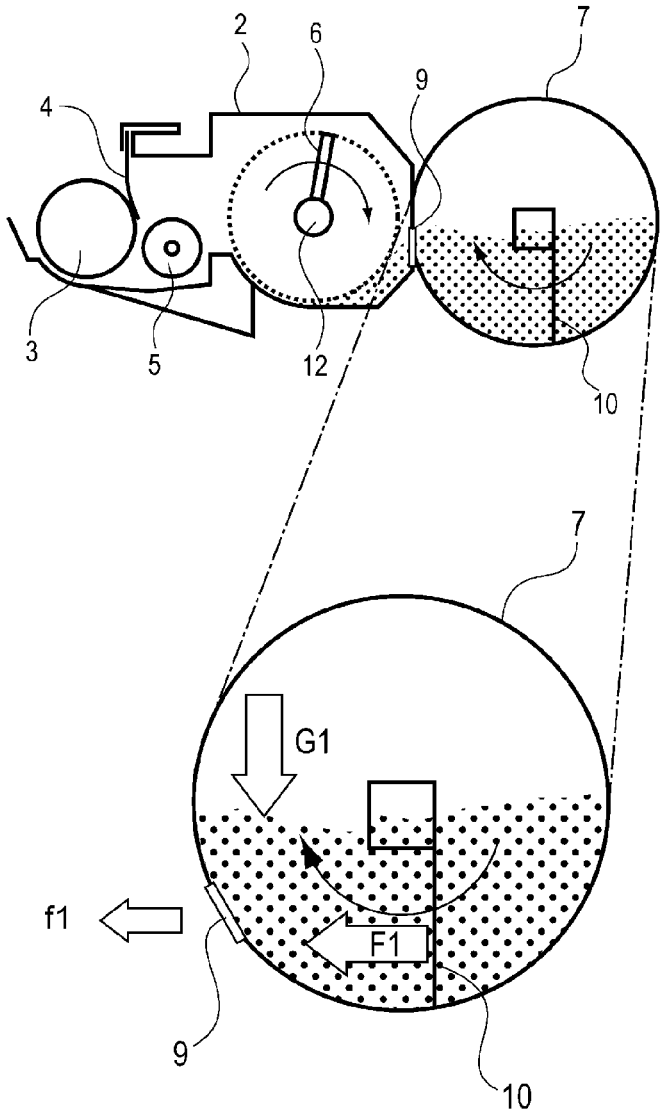
FIG. 20 is a diagram for describing the fifth embodiment according to the present invention.

As shown in FIG. 20, when the toner replenishing port 9 is provided at a low position, the conveying force of the agitation member 10 in the toner bottle 7 is denoted as F1, the pressure to the toner given by the gravity in the toner bottle 7 is denoted as G1, and the discharge from the toner bottle 7 to the developer container 2 is denoted as f1. In this case, the pressure G1 given by the gravity to the toner 8 increases around the replenishing port, and this acts as a force for cancelling the toner conveying force F1 of the agitation member 10, and decreases the discharge f1 from the toner bottle 7 to the developer container 2.

Figure 21:
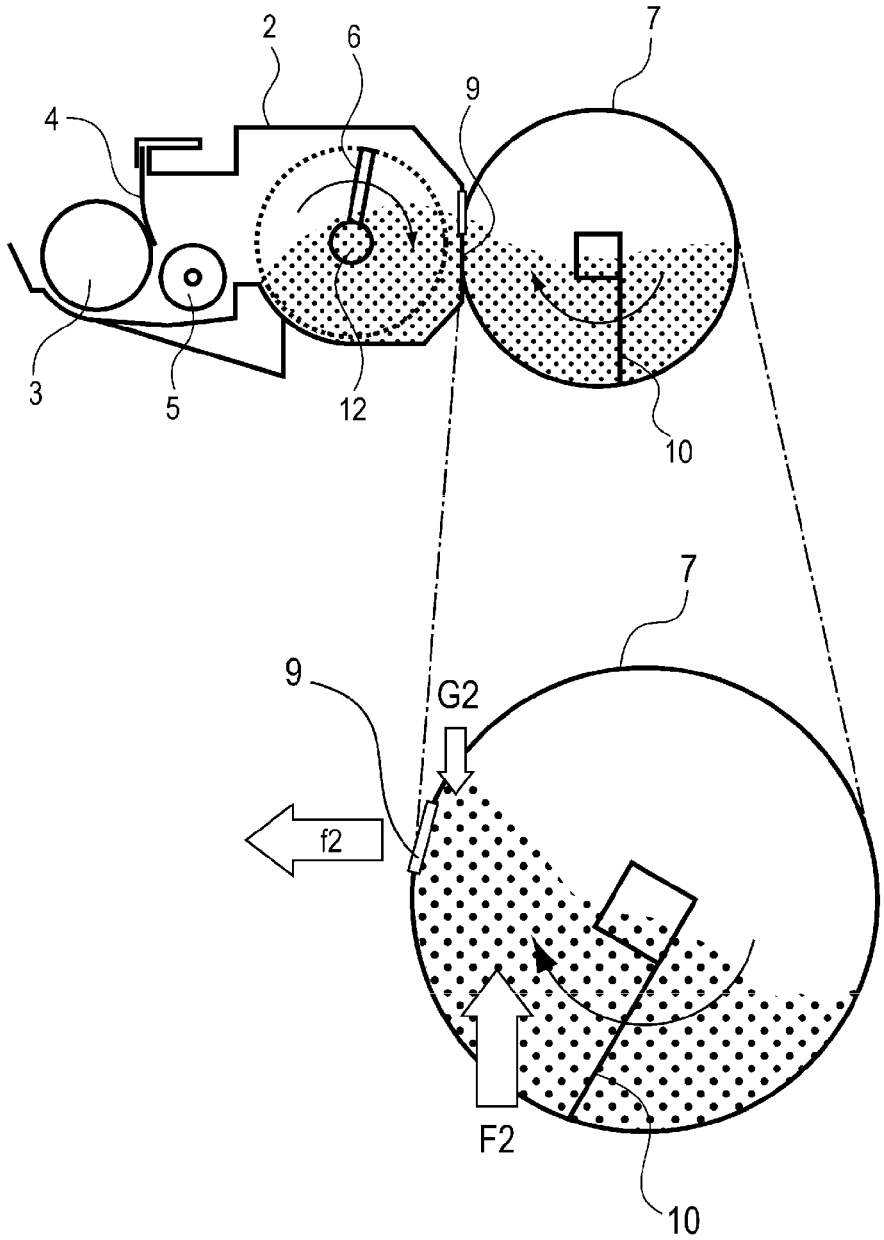
FIG. 21 is a diagram for describing the fifth embodiment according to the present invention.

On the other hand, as shown in FIG. 21, when the toner replenishing port 9 is provided at a high position, the toner conveying force with the agitation member 10 is denoted as F2, the gravity applied to the toner 8 in the toner bottle 7 is denoted as G2, and the discharge from the toner bottle 7 to the developer container 2 is denoted as f2. In this case, the gravity G2 applied to the toner 8 decreases around the replenishing port, and there is not a sufficient force for cancelling the toner conveying force F2 of the agitation member 10, and therefore, the discharge f2 from the toner bottle 7 to the developer container 2 becomes extremely large.

Figure 22:
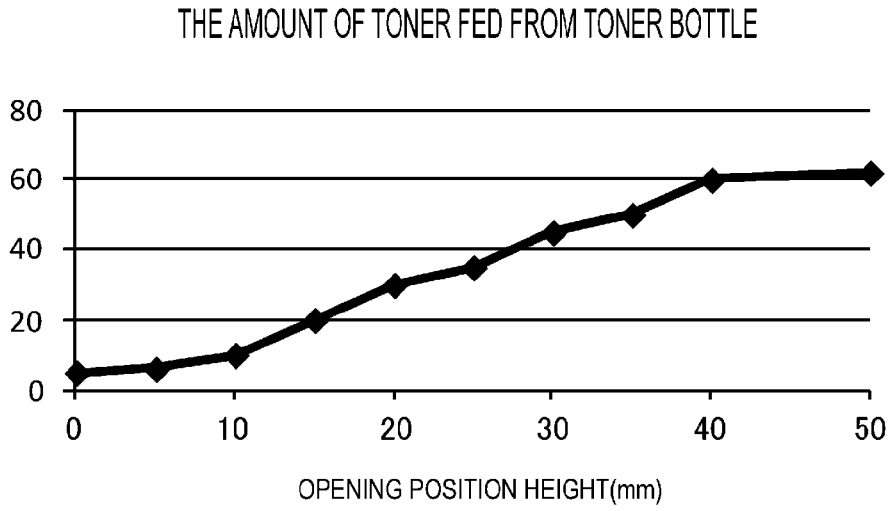
FIG. 22 is a graph illustrating a relationship between the height of the toner replenishing port and the amount of the toner fed from the toner bottle to the developer container.
Figure 23:
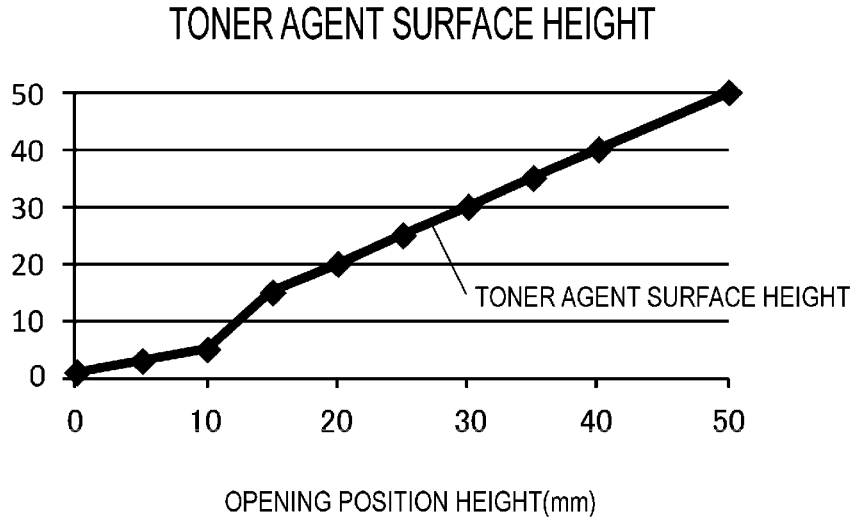
FIG. 23 is a graph illustrating a relationship between the height of the toner replenishing port and the toner agent surface height.

Therefore, the relationships of $G1>G2$, $F12\approx F2$, $f1<f2$ are satisfied with the height of the toner replenishing port 9. Therefore, the relationship between the height of the toner replenishing port 9 and the amount of toner 8 fed from the toner bottle 7 to the developer container 2 is a substantially proportional relationship as shown in FIG. 22, for example. The relationship of the height of the toner replenishing port 9 and the agent surface height 19 of the toner 8 in the developer container 2 is, for example, a substantially proportional relationship as shown in FIG. 23.

Therefore, by adjusting the height of the replenishing port in view of this relationship, the agent surface height 19 of the toner 8 in the developer container 2 can be adjusted. More specifically, the toner replenishing port 9 is provided so that, when the sheet member 14 is in a substantially vertical direction, the height of the lower end of the toner replenishing port 9 is a height equal to or more than the proximity to the gravity direction upper end of the second developer conveying portion 16 and equal to or less than the proximity to the rotation shaft 12 of the developer conveying apparatus 6, and therefore, the agent surface height 19 of the toner 8 in the developer container 2 can be set to the optimum position.

For the height of the lower end of the toner replenishing port 9, the height of the proximity to the gravity direction upper end of the second developer conveying portion 16 includes a case where the lower end of the toner replenishing port 9 is provided at a height which is lower, by about ten percent of the entire length in the gravity direction of the opening portion 17, from the gravity direction upper end of the second developer conveying portion 16 to the lower side in the gravity direction when the sheet member 14 is in the substantially vertical direction. This is because the same effects can be obtained even if the position is not exactly the upper end position of the second developer conveying portion 16 but is a position somewhat lower than that and lower by about ten percent of the entire length thereof.

For the height of the lower end of the toner replenishing port 9, the height equal to or less than the proximity to the rotation shaft 12 of the developer conveying apparatus 6 includes a case where the lower end of the toner replenishing port 9 is provided at a height higher, by about ten percent of the entire length in the gravity direction of the conveying surface 13, from the height of the rotation shaft 12 to the upper side in the gravity direction. This is the same as what has been described above, and this is because the same effects can be obtained even if the position is not exactly the height position of the rotation shaft 12 but is a position somewhat higher than that and higher by about ten percent of the entire length thereof.

In the present embodiment, the agent surface height 19 of the toner 8 in the developer container 2 is adjusted to be within the optimum position in accordance with the height position of the lower end of the toner replenishing port 9 as the replenish unit. A toner sensor which is a detection unit provided in the developing apparatus, for example, a magnetic permeability sensor, may detect the agent surface height 19 of the toner 8 in the developer container 2, and may be configured to adjust the agent surface height 19 to within the optimum position on the basis of the detection result.

For example, a magnetic bridge sensor which is a magnetic permeability sensor provides a different output depending on whether there is a magnetic body or there is not any magnetic body in front of the detection head. The highest output voltage is given when the maximum toner 8 is filled in the developer container 2, and the lowest output voltage is given when the toner remaining amount is vacant. Therefore, by performing control so as to obtain a predetermined toner remaining amount on the basis of the output voltage according to the remaining amount of the toner 8, the agent surface height 19 of the toner 8 in the developer container 2 can be set to the optimum position.

Sixth Embodiment

Figure 24:
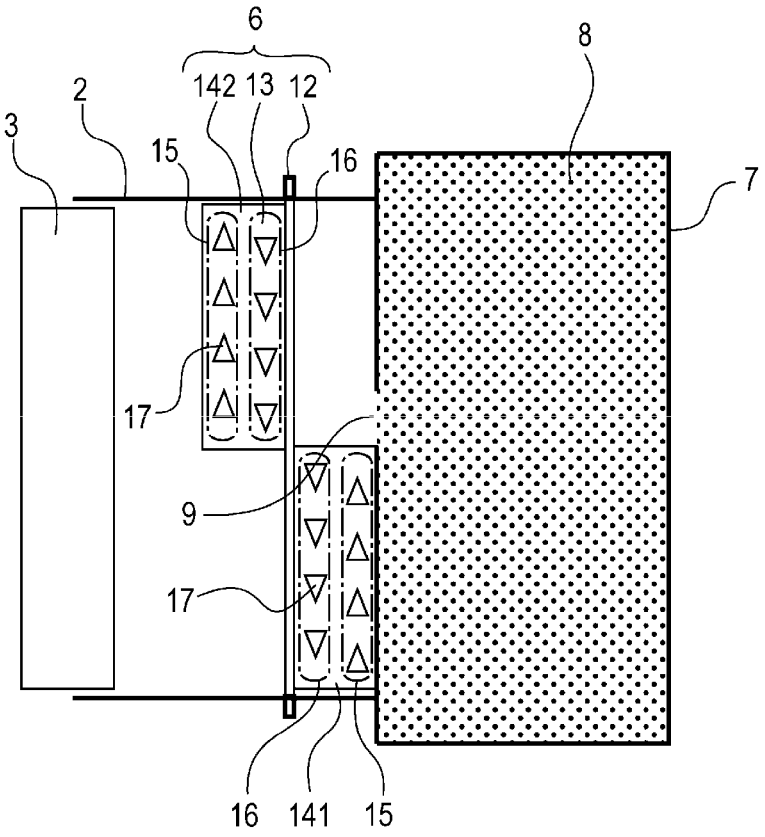
FIG. 24 is a diagram for describing a sixth embodiment according to the present invention.

FIG. 24 is a diagram for describing a sixth embodiment according to the present invention.

A rotation unit 14 includes developer conveying portions 15, 16 conveying a toner 8 to an axial direction of a rotation shaft 12 from a rotation center to a rotation end in the rotation radius direction. In a case where there is a single rotation unit 14, the load is applied to the same portion in the axial direction at a time, but when this is made into multiple rotation units (sheet members), the load distribution can be attained.

Two rotation units, i.e., a first rotation unit 141 serving as a first agitation and conveying member and a second rotation unit 142 serving as a second agitation and conveying member, are provided as the rotation units 14 by giving different rotation angles around the rotation shaft 12 with respect to the rotation shaft 12. When multiple rotation units 14 are arranged with the same rotation angle difference around the rotation shaft 12, the load in the rotation direction can be more uniformly distributed.

Further, the first rotation unit 141 and the second rotation unit 142 are arranged on the rotation shaft 12 in such a manner that the first rotation unit 141 and the second rotation unit 142 are shifted in the axial direction of the rotation shaft 12 in such a position relationship that the first rotation unit 141 and the second rotation unit 142 do not overlap each other with respect to the rotation direction of the rotation shaft. The two rotation units 141, 142 are arranged so that the ends of the two rotation units 141, 142 at the center side in the axial direction are arranged facing the toner replenishing port 9.

The developer container 2 accumulates the toner 8, which is to be conveyed from the toner replenishing port 9 to the toner conveying member 5, below the rotation shaft 12 of the developer conveying apparatus 6. The conveying surface 13 of each of the rotation units 141, 142 is provided with multiple developer conveying units for conveying and moving the toner along the axial direction of the rotation shaft 12 by moving around the rotation shaft 12 from the toner replenishing port 9 by way of the lower side in the inside of the developer container 2 to the toner conveying member 5.

For these multiple developer conveying units, the first developer conveying portion 15 and the second developer conveying portion 16 are formed in the conveying surface 13 of each of the first rotation unit 141 and the second rotation unit 142 to extend along the axial direction of the rotation shaft 12. The first developer conveying portion 15 of each of the two rotation units 141, 142 is provided together at the side of the rotation end in the rotation radius direction of the rotation shaft 12 with respect to the second developer conveying portion 16.

The first developer conveying portion 15 and the second developer conveying portion 16 are each provided with multiple opening portions 17, in a predetermined shape described later, arranged in a row on the developer conveying surface 13 of the sheet member 14. Accordingly, the conveying direction of the toner 8 with the first developer conveying portion 15 and the conveying direction of the toner 8 with the second developer conveying portion 16 are configured to be opposite directions to each other with respect to the axial direction of the rotation shaft 12.

The opening portion 17 has such a shape that the size of the opening (opening width) becomes larger in a direction perpendicular to the toner conveying direction along the axial direction. When the conveying surface 13 rotates about the axis of the rotation shaft 12, and the toner 8 pushed and moved by the conveying surface 13 passes through the opening portion 17 from the front side to the back side of the conveying surface 13 (the forward side to the backward side in the rotation direction), the toner 8 moves from the side where the opening width of the opening portion 17 is smaller to the side where the opening width of the opening portion 17 is larger. With this movement of the toner 8, the toner conveying operation is performed in the predetermined direction. As described above, the toner 8 is pushed and moved by the conveying surface 13 in a direction in which the pressure given by the toner 8 to the rotating conveying surface 13 decreases, and more specifically, the toner 8 is pushed and moved by the conveying surface 13 in a direction in which the opening width becomes larger, so that the toner conveying operation is performed in the predetermined direction.

Figure 25:
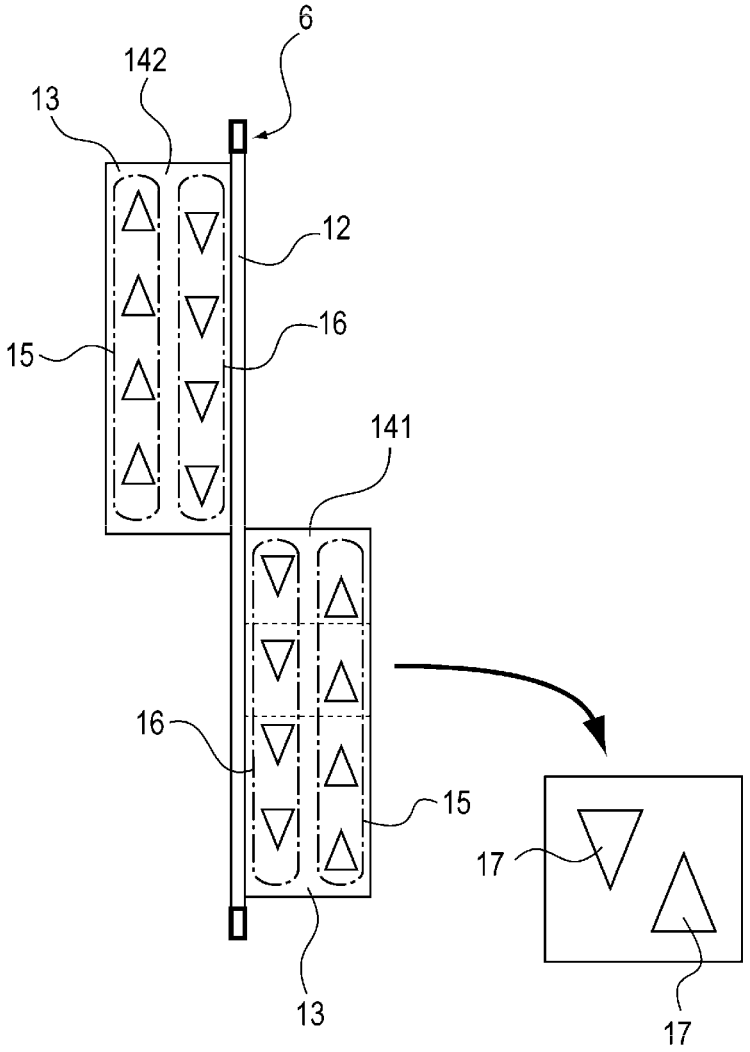
FIG. 25 is a diagram illustrating opening portions formed in a conveying surface of a rotation unit.

FIG. 25 is a diagram illustrating the opening portions 17 formed in the conveying surface 13 of each of the two rotation units 141, 142 serving as the developer conveying units.

The opening portion 17 is in such a shape that the vertex of the triangle is in a direction opposite to the direction in which the toner 8 is conveyed so that the opening width increases so as to reduce the pressure of the toner 8 received by the conveying surface 13. Therefore, the direction of the vertexes of the triangles of the multiple opening portions 17 of the first developer conveying portion 15 of each of the rotation units 141, 142 and the direction of the vertexes of the triangles of the multiple opening portions 17 of the second developer conveying portion 16 are in a relationship opposite to each other.

Further, the opening portions 17 of the first developer conveying portion 15 of the first rotation unit 141 and the opening portions 17 of the first developer conveying portion 15 of the second rotation unit 142 are in the same direction with respect to the axial direction of the rotation shaft 12. Likewise, the opening portions 17 of the second developer conveying portion 16 of the first rotation unit 141 and the opening portions 17 of the second developer conveying portion 16 of the second rotation unit 142 are in the same direction with respect to the axial direction of the rotation shaft 12.

Figure 26:
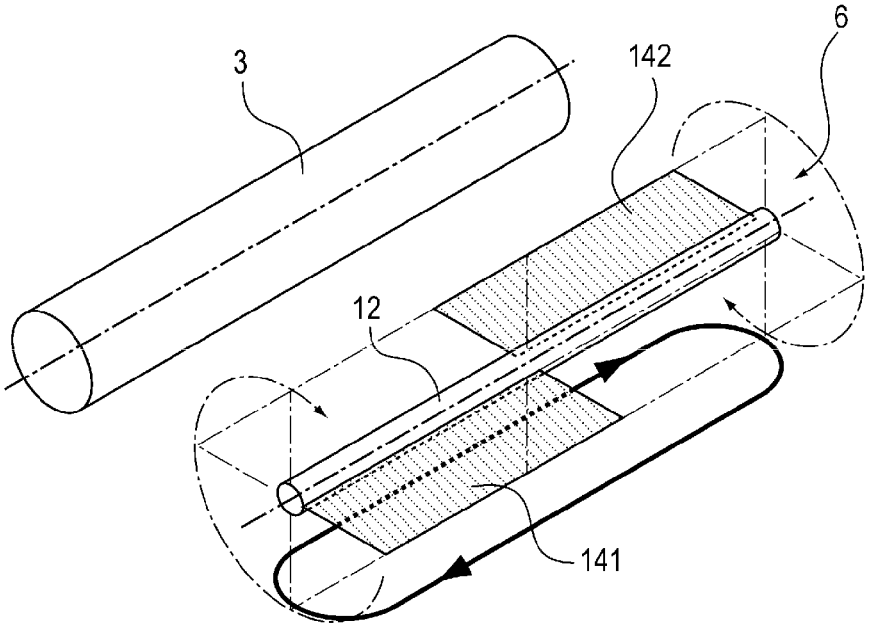
FIG. 26 is a diagram illustrating a conveying direction of a developer by the developer conveying unit of FIG. 25.

FIG. 26 is a diagram illustrating a conveying direction of the developer 8 by the developer conveying portions 15, 16 of FIG. 25.

According to the configuration of FIG. 25, the developer 8 conveyed to one end side of the first developer conveying portion 15 of each of the two rotation units 141, 142 is conveyed by the corresponding second developer conveying portion 16 so as to circulate toward the end portion side at the opposite side. As a result, in accordance with the rotation of the developer conveying apparatus 6, the developer conveying portions 15, 16 form the toner conveying path along the surface of the conveying surfaces 13 of the two rotation units 141, 142.

First, the toner 8 conveyed to one end side in the axial direction of the rotation shaft 12 by the first developer conveying portion 15 along the surface of the conveying surface 13 of the first rotation unit 141 is conveyed to a center side in the axial direction of the second developer conveying portion 16 of the first rotation unit 141 that rotates and comes subsequently. Then, the toner 8 is conveyed to the end side in the axial direction by the second developer conveying portion 16 of the second rotation unit 142 that rotates and comes subsequently. Subsequently, the toner 8 is conveyed again to the center side in the axial direction by the first developer conveying portion 15 of the second rotation unit 142 that rotates and comes subsequently.

According to this configuration, while reducing damage to the agitation and conveying member, the toner 8 can be agitated in a uniformized manner while preventing accumulation of the toner 8 at the end portion of the developer container 2.

Seventh Embodiment

Figure 27:
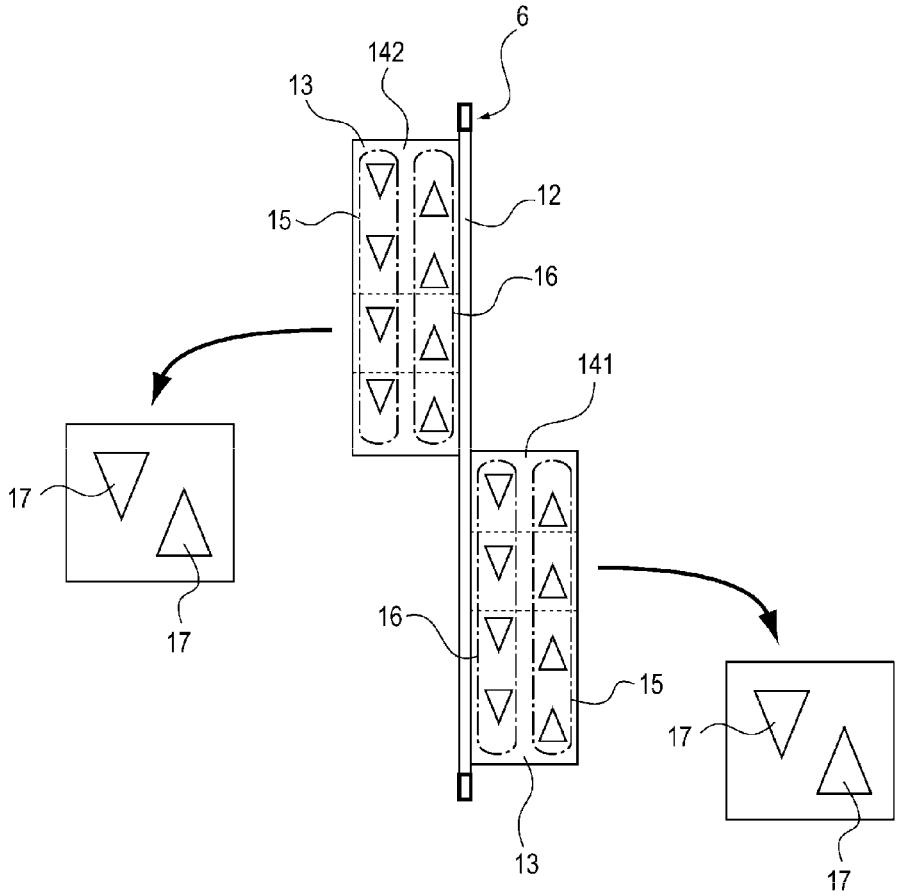
FIG. 27 is a diagram for describing a seventh embodiment of the present invention.

FIG. 27 is a diagram for describing the seventh embodiment of the present invention, and is a diagram illustrating other opening portions 17 formed in the conveying surface 13 of each of the two rotation units 141, 142 serving as the developer conveying units.

In this case, in the opening portions 17 of the first developer conveying portion 15 of the first rotation unit 141 and the opening portions 17 of the first developer conveying portion 15 of the second rotation unit 142, the opening shapes of the triangles are directions opposite to each other with respect to the axial direction of the rotation shaft 12. The vertex of the triangular shape of each opening faces the center side with respect to the axial direction. Likewise, in the opening portions 17 of the second developer conveying portion 16 of the first rotation unit 141 and the opening portions 17 of the second developer conveying portion 16 of the second rotation unit 142, the opening shapes of the triangles are directions opposite to each other with respect to the axial direction of the rotation shaft 12. The vertex of the triangular shape of each opening faces the end sides with respect to the axial direction.

Figure 28:
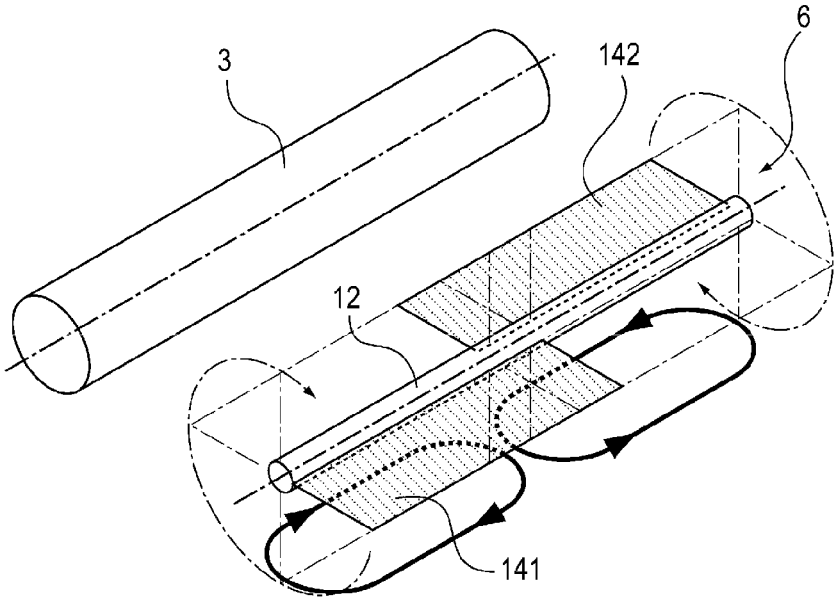
FIG. 28 is a diagram illustrating a conveying direction of a developer by the developer conveying unit of FIG. 27.

FIG. 28 is a diagram illustrating conveying directions of the developer 8 by the developer conveying portions 15, 16 of FIG. 27.

According to the configuration of FIG. 27, the toner 8 conveyed to the end side in the axial direction by the first developer conveying portion 15 of the first rotation unit 141 is conveyed to the center side in the axial direction by the second developer conveying portion 16 of the first rotation unit 141 that rotates and comes subsequently. In this case, the conveying direction of the second developer conveying portion 16 of the second rotation unit 142 that rotates and comes subsequently is the center side, and therefore, in this case, the toner 8 is hardly conveyed in the axial direction. Subsequently, the toner 8 is conveyed again to the center side in the axial direction by the first developer conveying portion 15 of the first rotation unit 141 that rotates and comes subsequently.

According to the configuration of FIG. 27, a toner conveying path for circulating the toner 8 within the conveying surface 13 of each of the two rotation units 141, 142 is formed.

According to this configuration, while reducing damage to the agitation and conveying member, the toner 8 can be agitated in a uniformized manner between the central portion and the end portions of the developer container 2.

Eighth Embodiment

Figure 29:
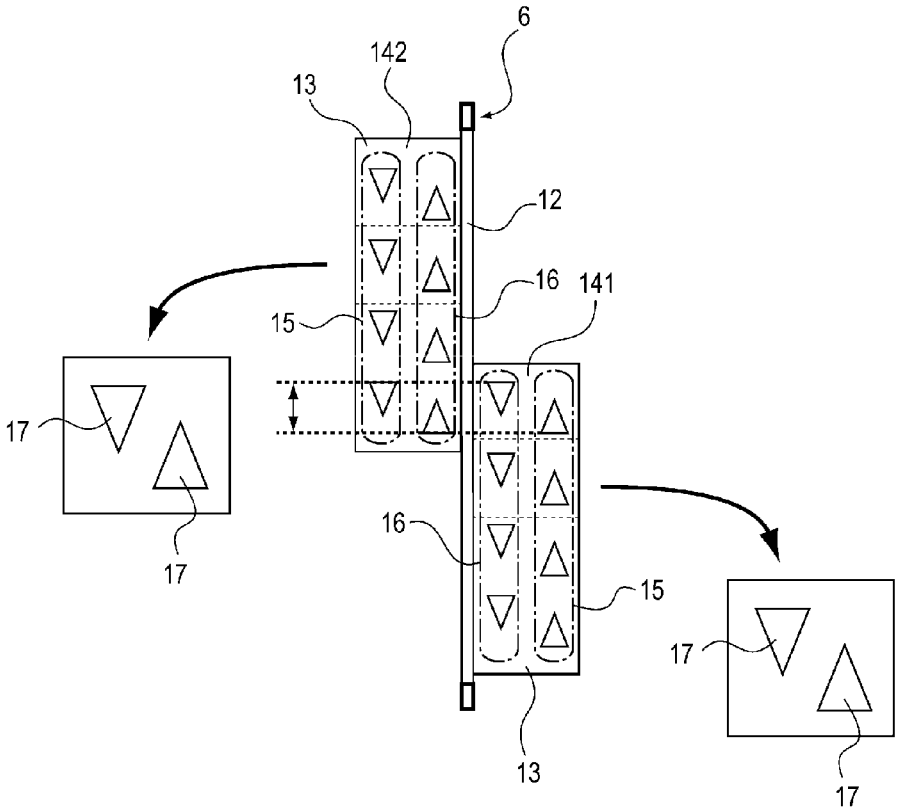
FIG. 29 is a diagram for describing an eighth embodiment according to the present invention.

FIG. 29 is a diagram for describing the eighth embodiment according to the present invention.

In this case, in addition to the configuration of the seventh embodiment, further, toner agitation areas of two rotation units 141, 142 of a developer conveying apparatus 6 are configured to be formed to partially overlap with respect to the rotation direction of the rotation units 141, 142. This configuration enables toner conveying operation in which the toner 8 conveyed in the axial direction of the rotation shaft 12 by the first rotation unit 141 is passed to the second rotation unit 142 via the partially overlapping area.

In the configurations according to the sixth and seventh embodiments, when the amount of the toner in the developer container 2 decreases, or when continuously printing images in which there is a difference in the lightness and darkness in the longitudinal direction of the developer container 2 (in the axial direction of the rotation shaft 12 of the developer conveying apparatus 6), it is difficult to maintain the state of the toner 8 in a uniform manner in the axial direction.

For example, in the configuration according to the sixth embodiment, when the remaining amount of the toner 8 decreases, the conveying directions of the first developer conveying units 15 of the two rotation units 141, 142 are the same, and therefore, the toner 8 in the developer container 2 is likely to be accumulated in a deviated manner at the end sides of the second rotation unit.

In the configuration according to the seventh embodiment, when continuously printing images in which there is a difference in the lightness and darkness in the axial direction of the rotation shaft 12, there occurs the difference in the lightness and darkness of the printed images due to degradation of the toner 8. This is because, for example, when continuously printing images of a high degree of lightness and darkness at the side of the second rotation unit 142, the toner 8 is actively consumed at the side of the second rotation unit 142, and therefore, the toner 8 at the side of the first rotation unit 141 is less likely to be consumed, and is accumulated in the developer container 2. For this reason, the degradation of the toner 8 at the side of the first rotation unit 141 is accelerated, and as a result, the lightness and darkness in the image is reduced.

In order to avoid such reduction in the lightness and darkness of the image, it is necessary to have a developer conveying apparatus 6 that can uniformize the state of the toner 8 in the longitudinal direction even when continuously printing images in which there is a difference in the lightness and darkness in the longitudinal direction or when the amount of the toner 8 decreases as described above.

Therefore, in the present embodiment, first, the toner 8 is conveyed by the first developer conveying portion 15 of each of the two rotation units 141, 142 to the end sides in the axial direction of the rotation unit of each of them, and is conveyed by the second developer conveying portion 16 of each of them to return back to the center side. At this occasion, at least between adjacent rotation units of the multiple rotation units 14, parts of the agitation areas for the developer of both of the rotation units 14 are configured to overlap each other to solve the above problem.

Figure 30:
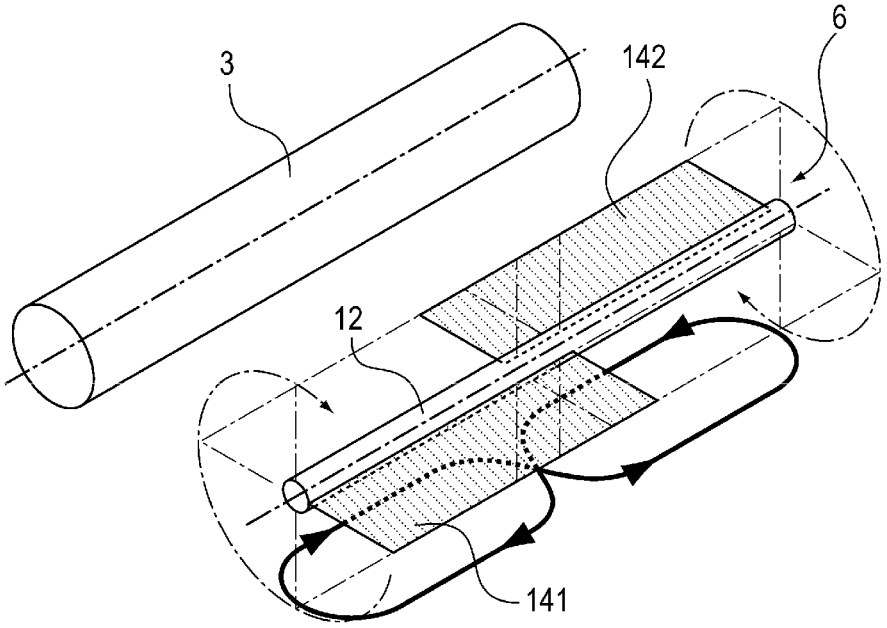
FIG. 30 is a diagram illustrating a conveying direction of a developer by the developer conveying unit of FIG. 29.

FIG. 30 is a diagram illustrating a conveying direction of the developer 8 by the developer conveying portions 15, 16 of FIG. 29.

According to the configuration of FIG. 29, first, the toner 8 is convey to the end side in the axial direction by each of the first developer conveying unit 15 of the first rotation unit 141 and the first developer conveying portion 15 of the second rotation unit 142. In this case, when the conveying surface 13 of the two rotation units 141, 142 is related to the rotation direction and is configured such that the agitation areas partially overlap each other, so that the toner 8 is conveyed by the second developer conveying portion 16 of the first rotation unit 141 to the first developer conveying portion 15 of the second rotation unit 142. This is because the second developer conveying portion 16 conveys the toner 8 to the overlapping area side, and accordingly, the toner 8 is conveyed by the first developer conveying portion 15 to the end side.

Likewise, the toner 8 is conveyed by the second developer conveying portion 16 of the second rotation unit 142 to the first developer conveying portion 15 of the first rotation unit 141.

As described above, the conveying surface 13 of the two rotation units 141, 142 is configured such that the agitation areas partially overlap each other with respect to the rotation direction, so that with the rotation of the developer conveying apparatus 6, the toner 8 is actively circulated between the two rotation units 141, 142. Therefore, even in a case of continuously printing images in which there is a difference in the lightness and darkness in the longitudinal direction of the developer container 2 (in the axial direction of the rotation shaft 12 of the developer conveying apparatus 6), the state of the toner 8 can be maintained in a more uniform manner.

Even when the amount of toner in the developer container 2 decreases, the conveying directions of the two developer conveying portions 15, 16 which are in the agitation area where the two rotation units 141, 142 overlap each other are in the opposite direction, and therefore, the state of the toner 8 can be uniformized in the axial direction in a more efficient manner.

Ninth Embodiment

Figure 31:
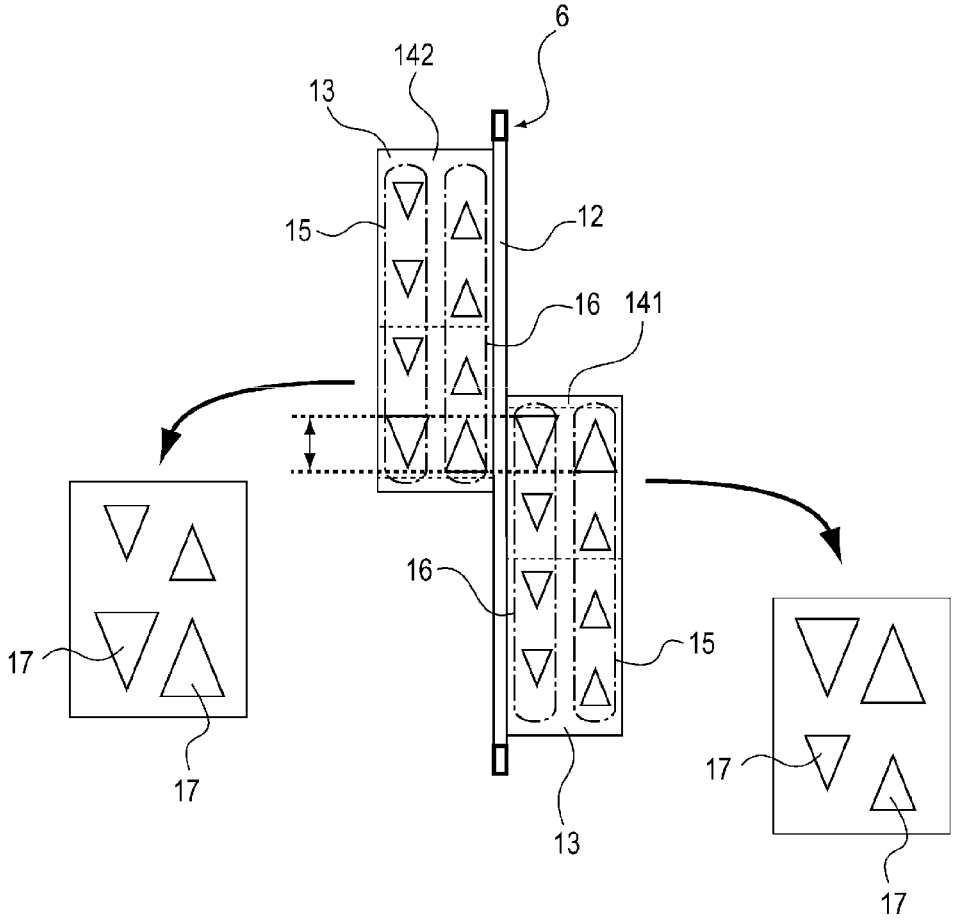
FIG. 31 is a diagram for describing a ninth embodiment according to the present invention.

FIG. 31 is a diagram for describing the ninth embodiment according to the present invention.

In this case, the configuration of the eighth embodiment is further made into a configuration in which the shapes of the opening portions 17 in a portion formed in a part of the toner agitation area of the two rotation units 141, 142 to be overlapping with respect to the rotation direction of the rotation units 141, 142 are made to be different from the shapes of the other opening portions 17.

In the configuration according to the eighth embodiment, the amount of the toner 8 conveyed is larger in the agitation area overlapping with respect to the rotation direction of the two rotation units 141, 142 than in the agitation area not overlapping. Therefore, the level of the lightness and darkness of the toner in the overlapping agitation area (the center side in the axial direction of the rotation shaft 12) is higher than at the end sides in the axial direction of the rotation shaft 12.

Therefore, the present embodiment is configured to solve the above problems on the basis of a finding, i.e., that the amount of toner conveyed by the developer conveying apparatus 6 can be changed by appropriately setting the shape of the opening portion 17 and each dimension of the shape thereof.

More specifically, the sizes of the opening portions 17 in the overlapping area, described above, of the rotation units 141, 142 are configured to be larger than the sizes of the other opening portions 17, so that the amount of the toner 8 conveyed in the overlapping area is reduced. As a result, the amount of the toner 8 passed between the two rotation units 141, 142 can be configured to be higher in the overlapping area than in the other areas, and the force for providing the toner 8 to the developing roller 3 in the overlapping area can be configured to be lower than the force for providing the toner 8 to the developing roller 3 in the non-overlapping area.

According to this configuration, even in a case of continuously printing images in which there is a difference in the lightness and darkness in the longitudinal direction of the developer container 2 (in the axial direction of the rotation shaft 12 of the developer conveying apparatus 6), the state of the toner 8 in the longitudinal direction can be maintained in a more uniform manner. Even when the amount of toner in the developer container 2 decreases, likewise, the state of the toner 8 in the longitudinal direction can be maintained in a more uniform manner.

Figure 32:
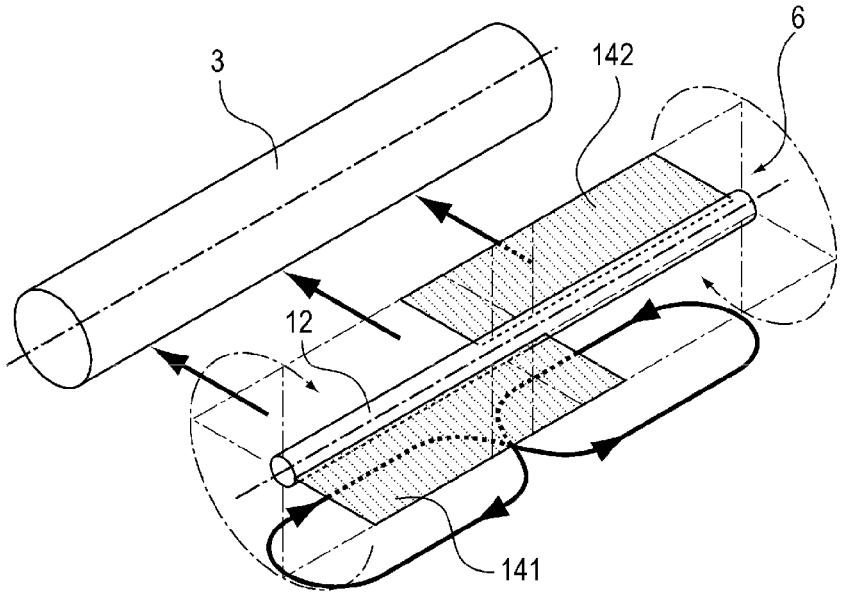
FIG. 32 is a diagram illustrating a conveying direction of a developer by the developer conveying unit of FIG. 31.

FIG. 32 is a diagram illustrating a conveying direction of the developer 8 by the developer conveying portions 15, 16 of FIG. 31.

The conveying direction of the toner 8 caused by the rotation of the developer conveying apparatus 6 is basically no different from the configuration of FIG. 30 according to the eighth embodiment with regard to the axial direction of the rotation shaft 12, but in the configuration of the present embodiment, further, the toner 8 can be more preferably uniformized in the axial direction. Accordingly, this can more greatly uniformize the lightness and darkness, in the axial direction of the rotation shaft 12, of the toner 8 conveyed by the developer conveying apparatus 6 to the developing roller 3.

The uniformized agitation state of the toner 8, which is the effect obtained from each of the above embodiments and the present embodiment can be confirmed from that fact that the change in the lightness and darkness of the reflection of the toner 8 is small in the axial direction.

Tenth Embodiment

FIGS. 33A to 33D are diagrams illustrating another aspect of opening portions 17.

In each of the embodiments described above, the opening in the triangular shape is used as the opening portion 17, but the shape of the opening is not limited thereto. Alternatively, the shape of the opening may be configurations as shown in FIGS. 33A to 33D. The shape of the opening portion 17 formed in the conveying surface 13 of the two rotation units 141, 142 may be a shape that causes movement of the toner 8, as indicated in each of the above embodiments, by the rotation of the developer conveying apparatus 6 inside of the developer container 2.

Figure 33A:
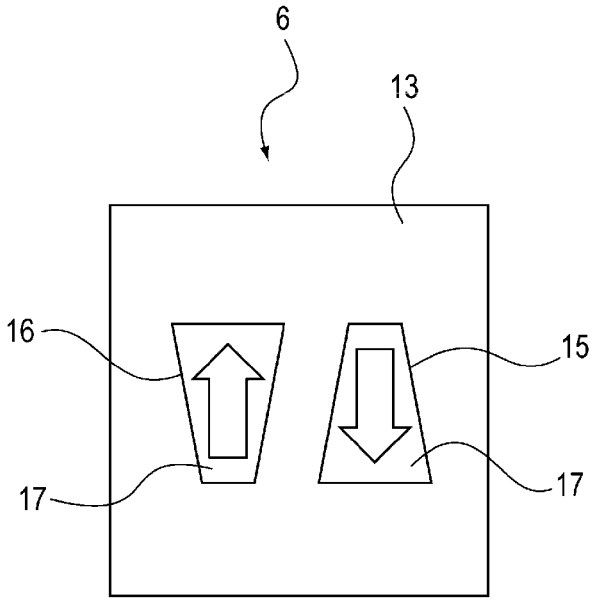
FIGS. 33A to 33D are diagrams illustrating another aspect of an opening portion 17 describing a tenth embodiment of the present invention.

FIG. 33A is a diagram for describing a shape of a trapezoid which serves as the opening portion 17 in place of the shape of the triangle.

This opening portion 17 arranges the trapezoid shape in the conveying surface 13 so that the size of the opening (opening width) becomes larger in the direction in which the toner 8 is to be conveyed. More specifically, the opening portions 17 in the trapezoid shape are provided, in place of the triangle opening portions 17 of the two developer conveying unit 15, 16, so that the upper base and the lower base of the trapezoid are positioned in the direction in which the toner 8 is to be conveyed, and the same agitation effects of the toner 8 are achieved.

Figure 33B:
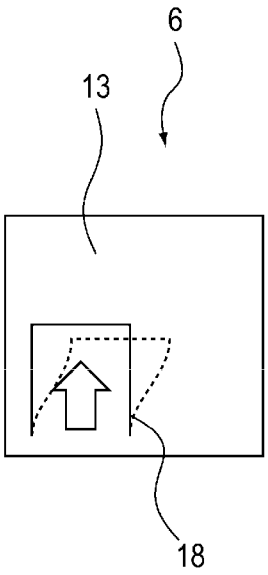
Figure 33C:
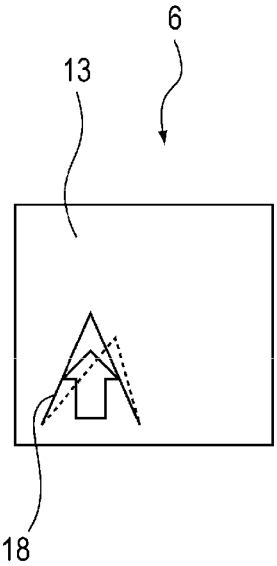
Figure 33D:
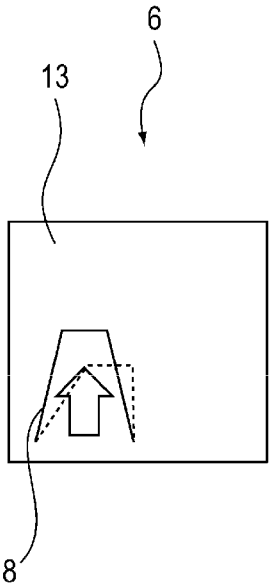

FIGS. 33B to 33D are diagrams for describing cut portions 18 that replace the opening portions 17.

The two developer conveying portions 15, 16 may be formed with cut portions 18 that are formed with openings bent to the backward side in the rotation direction in which the developer conveying apparatus 6 rotates about the rotation shaft 12 in a direction in which the toner 8 is to be conveyed.

The cut portion 18 is in such a shape that, in accordance with the rotation of the developer conveying apparatus 6, the toner 8 moves from the side where there is no cutting to the deformation piece forward-end side of the cut portion 18 by the pressure given by the toner 8 and received by the conveying surface 13 of the two rotation units 141, 142. When the pressure given by the toner 8 is applied to the conveying surface 13, the toner 8 moves in the direction in which the opening is formed in the cut portion 18, so that the toner 8 is conveyed in each of the predetermined directions.

The opening formed in the cut portion 18 may be in a C-shape shape, a triangular shape, or may be in a trapezoid shape (FIGS. 33B, 33C, 33D).

In the case of the C-shape shape cutting, the pressure of the toner 8 bends the cut portion 18 from the side where there is no cutting to the opposite side where a cutting is made. As described above, the toner 8 moves to the bent cut portion 18, so that the toner 8 can be conveyed.

In the base of the triangular shape cutting, the cutting is formed from the base of the triangle toward the vertex side so as to allow the cut portion 18 to be bent easily by the pressure of the toner 8, whereby the toner 8 is conveyed in that direction (the direction in which the opening width decreases).

In the case of the trapezoid shape cutting, a cutting is formed from the lower base side to the upper base side due to the same reason, and accordingly, the toner 8 is conveyed in that direction (the direction in which the opening width decreases). The trapezoid shape has a larger number of sides than the case of the triangular shape, and therefore, the size of the opening (opening width) in a direction perpendicular to the toner conveying direction can be easily adjusted, so that the amount of toner conveyed can be easily adjusted.

Eleventh Embodiment

Figure 34:
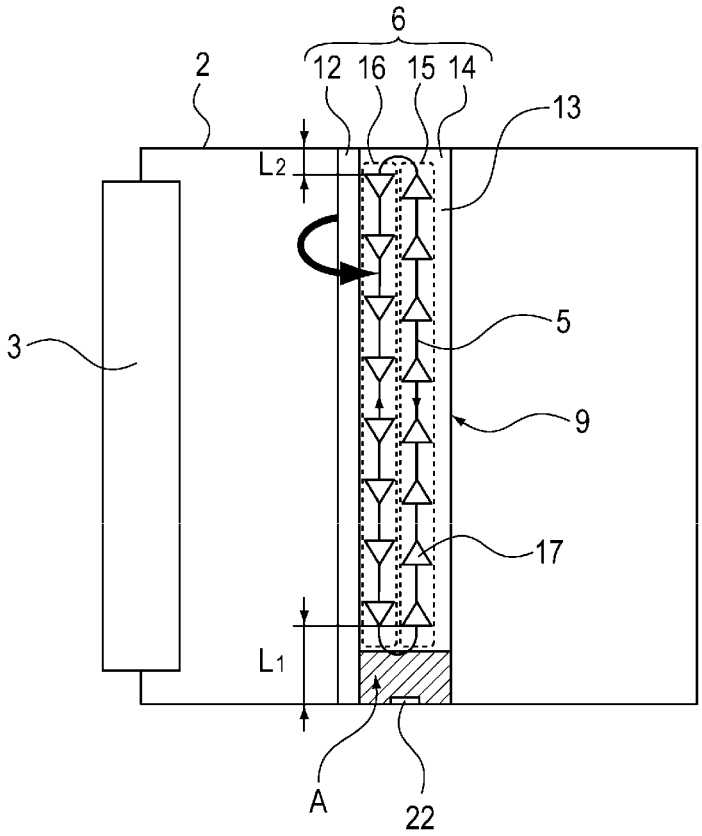
FIG. 34 is a diagram for describing an eleventh embodiment of the present invention.

FIG. 34 is a diagram for describing the eleventh embodiment according to the present invention.

[Configuration of Developer Conveying Portion and Developer Detectable Area]

On the first developer conveying portion 15 and the second developer conveying portion 16, opening portions 17 are formed to be arranged in rows along the rotation shaft 12 on the developer conveying surface 13.

Where an interval in which a developer detectable area A is located, which is between the opening portion 17, of these opening portions 17 arranged in rows, at the side end of the developer detection member 22 and the inner wall of the developer container 2 where the developer detection member 22 is provided, is denoted as L1, and an interval between the opening portion 17 at the row end at the opposite side and the inner wall of the developer container 2 at that side is denoted as L2, a relationship of L1>L2 is satisfied. With regard to this relationship, both of the arrangement of the opening portions 17 of the first developer conveying portion 15 and the arrangement of the opening portions 17 of the second developer conveying portion 16 have this relationship. The difference between the distances of L1 and L2 is equal to a single opening portion 17 that is fit in the axial direction of the rotation shaft 12.

In this case, the developer detectable area A means an area with which the developer detection member 22 can determined whether there is toner 8 or not.

The detection area of the developer detection member 22 according to the present embodiment is within 5 mm from the toner detection surface of the developer detection member 22. When the toner detection area of this developer detection member 22 is larger, the developer detectable area A also becomes larger accordingly.

[Configuration of Developer Detection Member]

As shown in FIG. 34, the developer detection member 22 is arranged on the inner surface of the developer container 2 at the position where a side of the rotation unit 14 along the rotation radius direction of the rotation unit 14 faces when the rotation unit 14 of the developer conveying apparatus 6 rotates around the rotation shaft 12.

Further, in the present embodiment, as shown in FIG. 34 seen from above the developer container 2, the two developer conveying portions 15, 16 made with the opening portions 17 arranged in rows in the conveying surface 13 of the rotation unit 14 do not have the opening portions 17 at the portion of the rotation unit 14 corresponding to the developer detectable area A. In this manner, the two developer conveying portions 15, 16 are not provided in the developer detectable area A. The developer detection member 22 is provided on the inner surface of the developer container 2 that faces this developer detectable area A.

The developer detection member 22 is a remaining amount detection system using a magnetic permeability sensor. The magnetic permeability sensor 22 outputs a sensor output voltage according to the magnetic permeability of the magnetic body included in the toner 8 in the developer detectable area A, and performs detection to determine whether this sensor output voltage value is more than a reference voltage value.

The magnetic permeability sensor 22 adopts a single rotation of the developer conveying apparatus 6 as a single cycle, and performs sampling with a regular interval in that single cycle. The number of times the detected sensor output voltage value becomes more than the reference voltage value is measured on the basis of a sampling result for a single cycle, and in a case where the number of times the detected sensor output voltage value becomes more than the reference voltage value per single sampling cycle of the magnetic permeability sensor 22 is less than a threshold value defined in advance, the toner is determined not to exist, and in a case where the number of times is equal to or more than the threshold value, the toner is determined to exist.

Figure 35A:
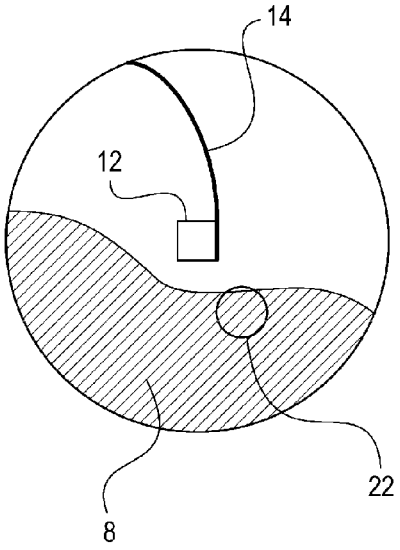
FIGS. 35A to 35B are cross sectional diagrams illustrating a configuration around the magnetic permeability sensor 22 which is seen from a side surface of the developer container 2.
Figure 35B:
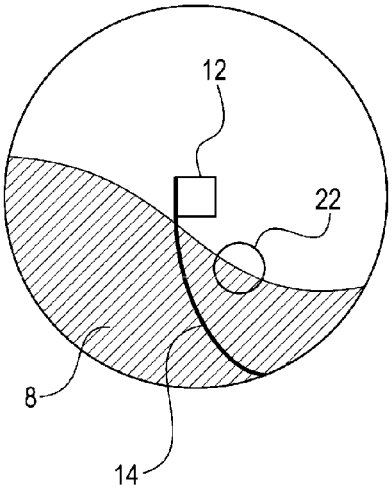

FIGS. 35A and 35B are cross sectional diagrams illustrating a configuration around the magnetic permeability sensor 22 which is seen from a side surface of the developer container 2, and schematically illustrating how the agent surface (toner surface) of the agitated toner 8 when the rotation unit 14 rotates about the center, i.e., the rotation shaft 12, in the inside of the developer container 2.

The present embodiment realizes a configuration in which the opening portion 17 is not provided in the conveying surface 13 of the rotation unit 14 that passes the developer detectable area A, and the first developer conveying portion 15 and the second developer conveying portion 16 are not provided in the developer detectable area.

With this configuration for suppressing the developer conveying function to the magnetic permeability sensor 22 in the developer detectable area A, the movement of the toner 8 is suppressed in the direction along the rotation shaft 12 by the developer conveying apparatus 6 in the developer detectable area A. Therefore, the toner conveying function to the magnetic permeability sensor 22 in the developer detectable area A can be suppressed.

As described above, the movement of the toner 8 in the axial direction of the rotation shaft 12 is suppressed, so that even when the rotation unit 14 is out of the toner pool (FIG. 35A), or even when the rotation unit 14 is rotating and moving in the toner pool (FIG. 35B), the upper and lower movement of the toner surface height of the toner 8 in the developer detectable area A is alleviated. For this reason, the precision of the toner presence/absence detection of the magnetic permeability sensor 22 can be more stabilized.

Subsequently, while the toner 8 in the developer container 2 is consumed, the output of the remaining amount detection by the magnetic permeability sensor 22 is monitored, and the measurement is performed twice.

Figure 36:
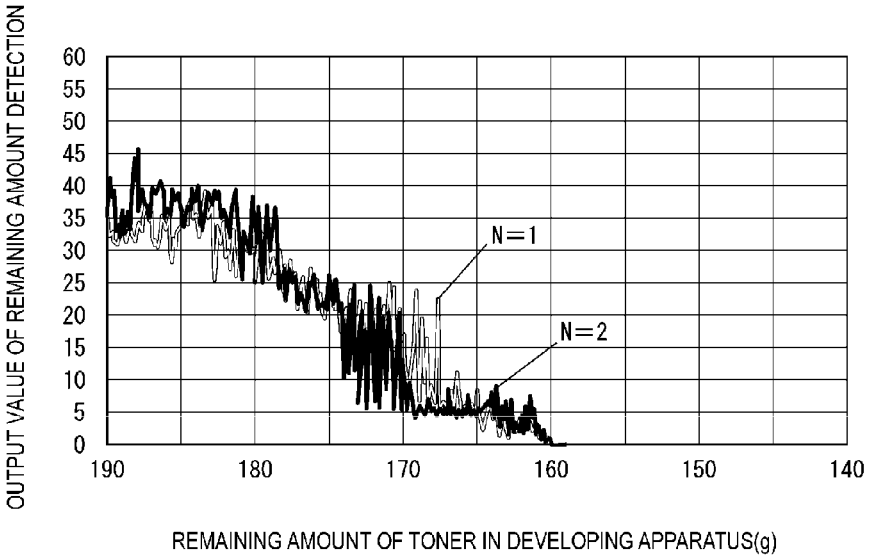
FIG. 36 is a figure expressing a detection output of the magnetic permeability sensor with respect to a toner remaining amount in the developer container.

FIG. 36 is a measurement result thereof, and is a figure illustrating a detection output of the magnetic permeability sensor 22 with respect to a toner remaining amount in the developer container 2, in which the vertical axis indicates the output value of the remaining amount detection, and the horizontal axis indicates a toner remaining amount in the developer container 2.

Since the toner surface height in the developer detectable area A is stable, the detection output of the magnetic permeability sensor 22 has small ripples in the remaining amount detection output value in both of the first measurement (N=1) and the second measurement (N=2), and the toner remaining amount in the developer container 2 can be detected with a high degree of accuracy.

Comparative Example

Figure 37:
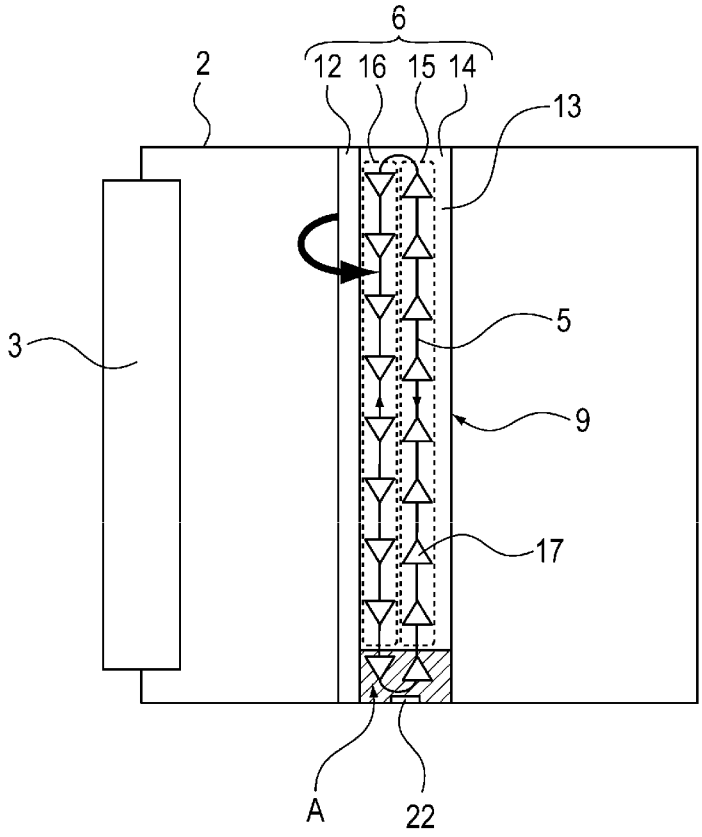
FIG. 37 is a diagram illustrating the inside of the developer container according to a comparative example, seen from above.

FIG. 37 is a diagram illustrating, as a comparative example, a developing apparatus 1, which is manufactured by way of experiment and is being considered before coming into publicly-known, provided with the magnetic permeability sensor 22 at the same position as the present embodiment, and the inside of the developer container 2 is seen from above.

As shown in FIG. 37, the conveying surface 13 of the rotation unit 14 included in the developer detectable area A is provided with opening portions 17 at the end portions of the two developer conveying portions 15, 16, and it is understood that two developer conveying units 15, 16 exist in this developer detectable area A.

Figure 38A:
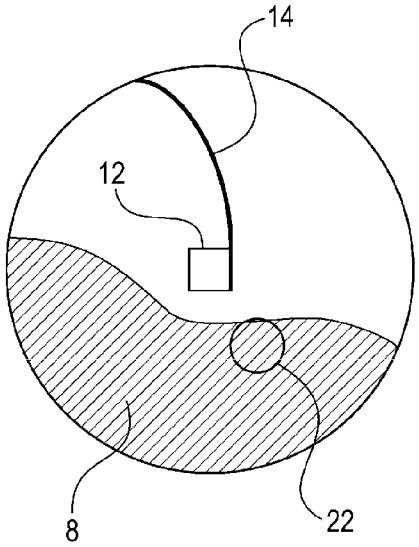
FIGS. 38A to 38B are cross sectional diagrams, seen from a side surface of the developer container, a configuration around the magnetic permeability sensor according to the comparative example.
Figure 38B:
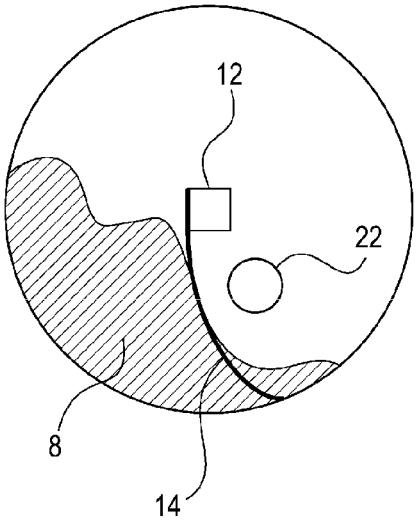

FIGS. 38A to 38B are cross sectional diagrams, seen from a side surface of the developer container 2, of a configuration around the magnetic permeability sensor 22 according to the comparative example. This schematically illustrates the state of change of the agent surface of the agitated toner 8, which is caused when the rotation unit 14 rotates around the rotation shaft 12 in the developer container 2.

In this comparative example, when the developer conveying apparatus 6 rotates, the toner 8 in the developer container 2 includes a toner 8 conveyed to the end portion of the developer container 2 (the end portion in the axial direction of the rotation shaft 12) by the first developer conveying portion 15 provided in the conveying surface 13 of the rotation unit 14 and a toner 8 conveyed to the end portion at the side opposite to the end portion of the developer container 2 by the second developer conveying portion 16.

As described above, every time the toner 8 is agitated by the developer conveying apparatus 6, at the end portion of the developer container 2, the toner 8 rushes to the axial direction end portion of the developer conveying apparatus 6 of the developer container 2, and the toner 8 at the end portion of the developer container 2 is conveyed to the inner side of the developer container 2. For this reason, when the rotation unit 14 is out of the toner pool (FIG. 38A) and when the rotation unit 14 is rotating and moving in the toner pool (FIG. 38B), the toner surface height greatly moves up and down, and the toner surface height becomes unstable.

Subsequently, while the toner 8 in the developer container 2 according to the comparative example is consumed, the output of the remaining amount detection by the magnetic permeability sensor 22 is monitored, and the measurement is performed twice.

Figure 39:
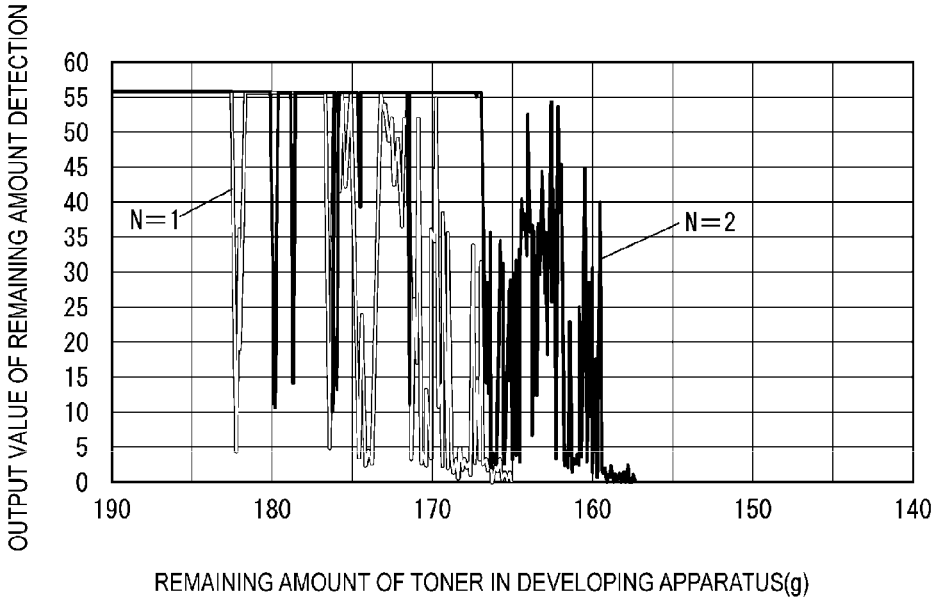
FIG. 39 is a figure expressing a detection output of the magnetic permeability sensor with respect to a toner remaining amount in the developer container according to the comparative example.

FIG. 39 is a measurement result thereof, and is a figure illustrating a detection output of the magnetic permeability sensor 22 with respect to a toner remaining amount in the developer container 2, in which the vertical axis indicates the output value of the remaining amount detection, and the horizontal axis indicates a toner remaining amount in the developer container 2.

The toner surface height at the end portion of the developer container 2 greatly changed up and down and unstable, and therefore, the output of the remaining amount detection by the magnetic permeability sensor 22 becomes unstable, and in both of the first measurement (N=1) and the second measurement (N=2), the ripple of the remaining amount detection output value by the magnetic permeability sensor 22 is large, and the actual toner remaining amount in the developer container 2 when the toner is determined not to exist is greatly different, and in the configuration of the comparative example, detection cannot be performed with a high degree of accuracy.

Twelfth Embodiment

Figure 40:
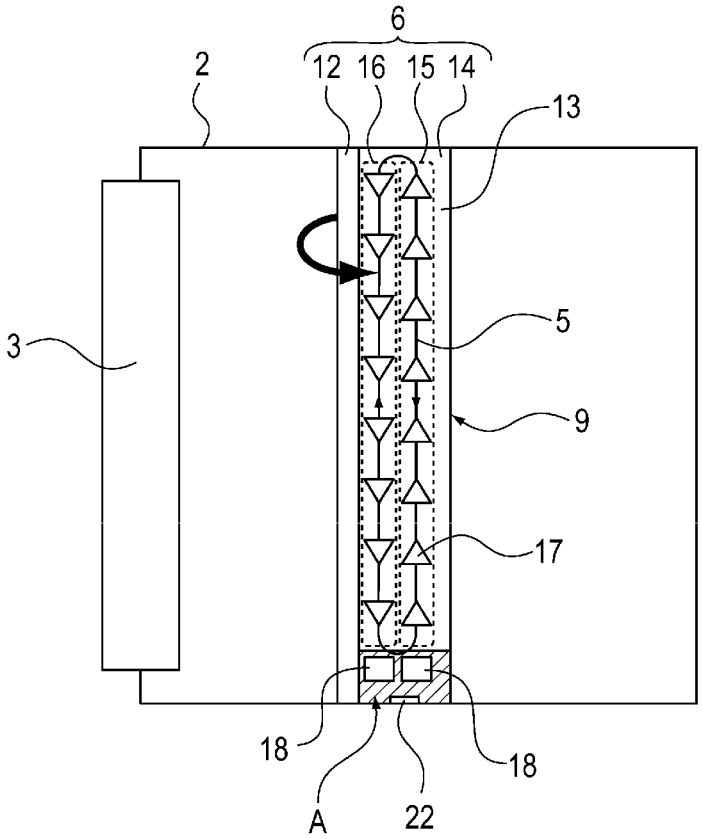
FIG. 40 is a diagram illustrating the inside of a developing apparatus according to a twelfth embodiment of the present invention, seen from above.

FIG. 40 is a diagram illustrating a developing apparatus 1 according to the twelfth embodiment of the present invention, wherein the inside thereof is seen from above.

In the twelfth embodiment, as a configuration not having the two developer conveying portions 15, 16 provided in the developer detectable area A, the twelfth embodiment has such a shape not having any toner conveying function in the direction along the axial direction of the rotation shaft 12, and the opening portion 18 for conveying the toner 8 is provided on a surface at the side opposite to one of the surfaces of the rotation unit 14. Except the above, the twelfth embodiment has the same configuration as the developing apparatus 1 according to the eleventh embodiment.

The shape of the opening portion 18 has such a shape in which, with respect to a direction from which the toner is conveyed, the width of the opening perpendicular to that direction is constant.

When the developer conveying apparatus 6 rotates, the first developer conveying portion 15 and the second developer conveying portion 16 moves the toner in the axial direction of the rotation shaft 12 and moves the toner to the developing roller 3. With regard to the toner 8 in the developer detectable area A, the toner flow to the magnetic permeability sensor 22 and the toner flow leaving the magnetic permeability sensor 22 can be greatly suppressed by the opening portions 18 that do not have any conveying function in the direction along the axial direction of the rotation shaft 12. Further, the amount of toner conveyed to the developing roller 3 at the end portion of the magnetic permeability sensor 22 of the developer conveying apparatus 6 can also be suppressed.

Therefore, the toner conveying function to the magnetic permeability sensor 22 in the developer detectable area A can be suppressed.

With this configuration for suppressing the developer conveying function to the magnetic permeability sensor 22 in the developer detectable area A, the up and down movement of the toner surface height of the toner 8 in the developer detectable area A is alleviated, and therefore, the precision of the toner presence/absence detection of the magnetic permeability sensor 22 can be more stabilized.

According to the configuration of the present embodiment, in the output result of the magnetic permeability sensor 22, the ripple of the remaining amount detection output value is reduced because of the stabilization of the toner surface height in the developer detectable area A, and the toner remaining amount in the developer container 2 can be detected with a high degree of precision.

The configuration of the present embodiment is effective when the amount of toner conveyed in the direction of the developing roller 3 at the end portion at the magnetic permeability sensor 22 increases.

Thirteenth Embodiment

Figure 41:
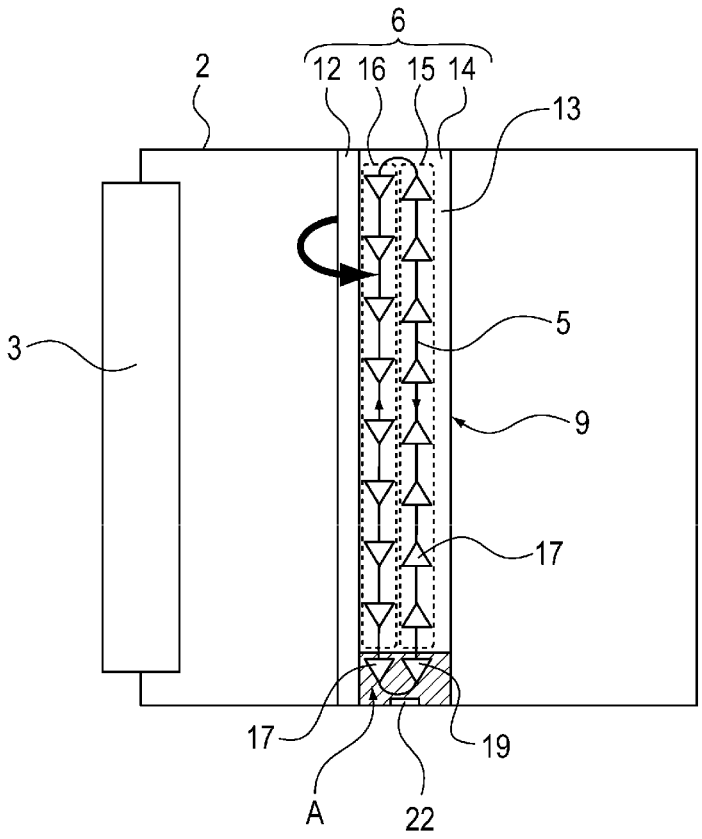
FIG. 41 is a diagram illustrating the inside of a developing apparatus according to a thirteenth embodiment of the present invention, seen from above.

FIG. 41 is a diagram illustrating a developing apparatus 1 according to the thirteenth embodiment of the present invention, wherein the inside thereof is seen from above.

In the thirteenth embodiment, opening portions 17 of a second developer conveying portion 16 for conveying toner to a center side in an axial direction of a rotation shaft 12 in a developer detectable area A is provided, but opening portions 17 of a first developer conveying portion 15 for conveying toner to the end portion side where there is a magnetic permeability sensor 22 is not provided. At this position, an opening portion 19 having the same arrangement as the opening portions 17 of the second developer conveying portion 16 and conveying toner to the center side in the axial direction of the rotation shaft 12 is provided. Except the above, the thirteenth embodiment has the same configuration as the developing apparatus 1 according to the eleventh embodiment.

The opening portion 17 and the opening portion 19 have such a shape that the size of the opening (opening width) in a direction perpendicular to the toner conveying direction along the axial direction becomes larger in the toner conveying direction. More specifically, with this shape of the openings, a toner flow is formed from a side where the opening width is smaller to a side where the opening width is larger, and accordingly, both of the opening portion 17 and the opening portion 19 having a triangular shape of which a base is at the axial direction center side in the developer detectable area A which has been described above performs an action of toner conveying operation to the center side in the axial direction.

Therefore, when the developer conveying apparatus 6 rotates, the opening portion 17 and the opening portion 19 in the developer detectable area A conveys the toner at the end portion of the rotation unit 14 at the magnetic permeability sensor 22 so as to move the toner to the center side in the axial direction of the rotation shaft 12. In addition, the rotation unit 14 that is rotating and moving also conveys the toner to the developing roller 3.

With this configuration for suppressing the developer conveying function to the magnetic permeability sensor 22 in the developer detectable area A, the toner conveying function to the magnetic permeability sensor 22 in the developer detectable area A can be suppressed, and therefore, the change in the toner surface height in the developer detectable area A is reduced, and the toner surface height is stabilized. Therefore, in the output result of the magnetic permeability sensor 22, the ripple of the remaining amount detection output value is reduced, and the toner remaining amount in the developer container 2 can be detected with a high degree of precision.

The configuration of the present embodiment is effective when the toner surface height at the end portion at the magnetic permeability sensor 22 is high. The configuration of the present embodiment is also effective in a configuration in which the amount of toner is likely to be high at the end portion at the magnetic permeability sensor 22, e.g., a configuration in which the toner replenishing port 9 is provided at a position closer to the magnetic permeability sensor 22 than the central portion of the rotation shaft 12.

Fourteenth Embodiment

Figure 42:
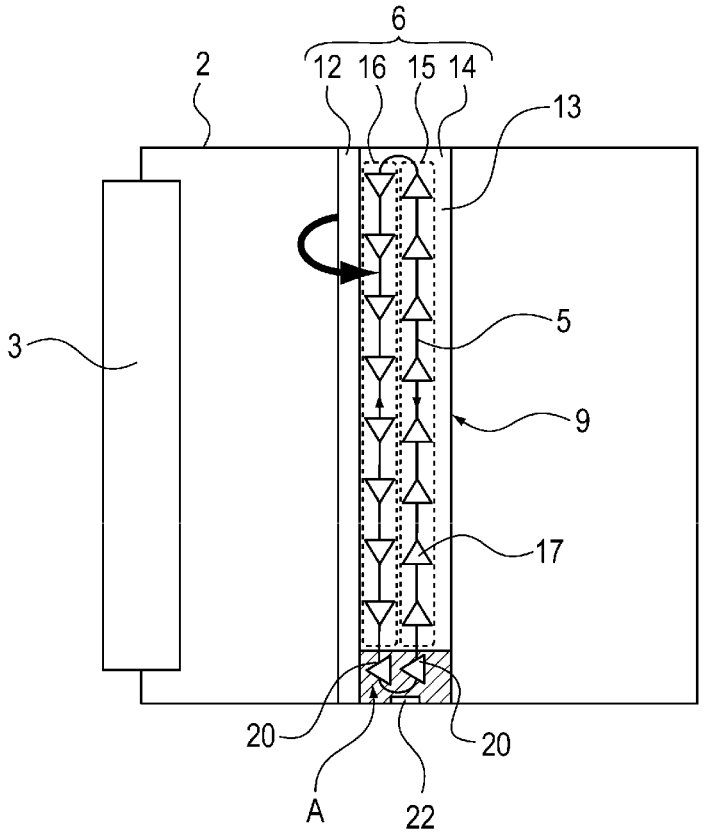
FIG. 42 is a diagram illustrating the inside of a developing apparatus according to a fourteenth embodiment of the present invention, seen from above.

FIG. 42 is a diagram illustrating a developing apparatus 1 according to the fourteenth embodiment of the present invention, wherein the inside thereof is seen from above.

In the fourteenth embodiment, an opening portion 20 for conveying the toner 8 to a rotation direction free end side of the rotation unit 14 (rotation radius outer side of the rotation unit 14) is provided at the end portion of each of the two developer conveying portions 15, 16 at the magnetic permeability sensor 22 in the developer detectable area A. Except the above, the fourteenth embodiment has the same configuration as the developing apparatus 1 according to the eleventh embodiment.

These two opening portions 20 have such a shape that the size of the opening (opening width) in a direction perpendicular to the free end direction of the rotation direction of the sheet member 14 becomes larger toward the free end of the rotation unit 14, and therefore, the toner conveying operation to the magnetic permeability sensor 22 by the developer conveying apparatus 6 can be suppressed. Accordingly, the toner conveying function to the magnetic permeability sensor 22 in the developer detectable area A can be suppressed.

According to this configuration, the toner conveying operation to the developing roller 3 in accordance with the rotation movement of the rotation unit 14 is not suppressed.

With this configuration for suppressing the developer conveying function to the magnetic permeability sensor 22 in the developer detectable area A, the toner conveying operation to the magnetic permeability sensor 22 by the rotation unit 14 is suppressed, and therefore, the change in the toner surface height in the developer detectable area A is reduced, and the toner surface height is stabilized. Therefore, in the output result of the magnetic permeability sensor 22, the ripple of the remaining amount detection output value is reduced, and the toner remaining amount in the developer container 2 can be detected with a high degree of precision.

The present embodiment has the configuration for actively conveying the toner 8 in proximity to the magnetic permeability sensor 22 to the radius direction outer side of the rotation unit 14, and therefore, the present embodiment is effective when the magnetic permeability sensor 22 is attached to a position at a height equal to or less than one third of the side wall of the developer container 2 in the height direction.

Fifteenth Embodiment

Figure 43:
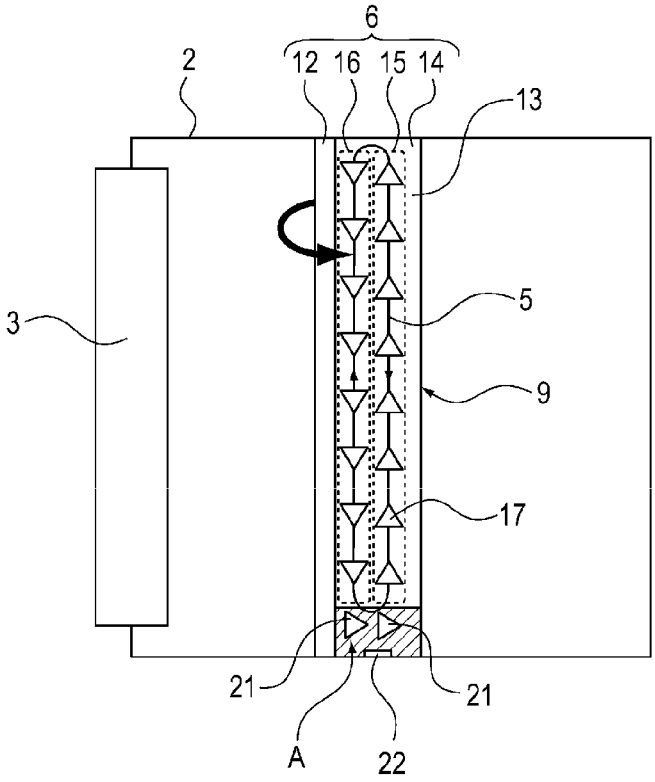
FIG. 43 is a diagram illustrating the inside of a developing apparatus according to a fifteenth embodiment of the present invention, seen from above.

FIG. 43 is a diagram illustrating a developing apparatus 1 according to the fifteenth embodiment of the present invention, wherein the inside thereof is seen from above.

In the fifteenth embodiment, an opening portion 21 for conveying the toner 8 to a rotation shaft side of the rotation unit 14 (rotation radius inner side of the rotation unit 14) is provided at the end portion of each of the two developer conveying portions 15, 16 at the magnetic permeability sensor 22 in the developer detectable area A. Except the above, the fifteenth embodiment has the same configuration as the developing apparatus 1 according to the eleventh embodiment.

These two opening portions 21 have such a shape that the size of the opening (opening width) in a direction perpendicular to the free end direction of the rotation unit 14 becomes larger toward the fixed end of the rotation unit 14, and therefore, the toner conveying operation to the magnetic permeability sensor 22 by the developer conveying apparatus 6 can be suppressed. Accordingly, the toner conveying function to the magnetic permeability sensor 22 in the developer detectable area A can be suppressed.

According to this configuration, the toner conveying operation to the developing roller 3 in accordance with the rotation movement of the rotation unit 14 is not suppressed.

With this configuration for suppressing the developer conveying function to the magnetic permeability sensor 22 in the developer detectable area A, the toner conveying operation to the magnetic permeability sensor 22 by the rotation unit 14 is suppressed, and therefore, the change in the toner surface height in the developer detectable area A is reduced, and the toner surface height is stabilized. Therefore, in the output result of the magnetic permeability sensor 22, the ripple of the remaining amount detection output value is reduced, and the toner remaining amount in the developer container 2 can be detected with a high degree of precision.

The present embodiment has the configuration for actively conveying the toner 8 in proximity to the magnetic permeability sensor 22 to the radius direction inner side of the rotation unit 14, and therefore, the present embodiment is effective when the magnetic permeability sensor 22 is attached to a position at a height equal to or less than one third of the side wall of the developer container 2 in the height direction.

The first embodiment to the fifteenth embodiment described above have been described using the developing apparatus that employs the replenish method having the replaceable toner bottle 7, but the present invention is not limited thereto. The same effects can be obtained with a cartridge that employs a disposable method.

The first embodiment to the fifteenth embodiment described above have been described using the developing apparatus, but the present invention is not limited thereto. The present invention can also be used for a developer providing apparatus, a developer replenish container, and a cleaning apparatus that use a sheet-like rotation conveying member.

When the present invention is used for a rotation conveying member provided in a developer replenish container (toner bottle) that is detachable to the developing apparatus and conveying toner in the toner bottle, the present invention can eliminate unevenness of the toner in the toner bottle, and the toner can be replenished to the developing apparatus.

There exists an image forming apparatus including a developer providing apparatus (hopper) that is provided between a developer replenish container (toner bottle) and a developing apparatus and temporarily accumulates toner to performs toner replenishing in a more stable manner by replenishing the toner to the developing apparatus via the hopper. When the present invention is used for the rotation conveying member provided in this hopper, the unevenness of the toner in the hopper is eliminated, and the state of the toner in the hopper is uniformized.

A sheet-like rotation conveying member according to the present invention can also be used for a cleaning apparatus that causes a cleaning blade to be in a pressurized contact with a photosensitive body drum and uses this blade to scrape and collect the developer remaining on the photosensitive body drum. The cleaning apparatus includes a rotation conveying member for conveying the collected toner, and when the present invention is used for this rotation conveying member, the cleaning apparatus capable of conveying the developer without clogging the developer while preventing accumulation of the collected developer can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2014-259856, filed Dec. 24, 2014, No. 2014-259857, filed Dec. 24, 2014, No. 2014-259858, filed Dec. 24, 2014, No. 2014-259859, filed Dec. 24, 2014, No. 2014-259860, filed Dec. 24, 2014, No. 2014-259861, filed Dec. 24, 2014, which are hereby incorporated by reference herein in their entirety.

What is claimed is:

1. A developer conveying apparatus for conveying a developer that develops an electrostatic latent image, comprising a rotation plate member which rotates around a rotation shaft;

wherein the rotation plate member has a first developer conveying portion which is provided with first openings for conveying the developer in a first axial direction of the rotation shaft; and a second developer conveying portion which is provided with second openings for conveying the developer in a second axial direction opposite to the first axial direction, wherein a shortest distance from the rotation shaft to the first openings is different than a shortest distance from the rotation shaft to the second openings.

2. The developer conveying apparatus according to claim 1, wherein the first openings and the second openings are each arranged in a predetermined shape in the rotation plate member along an axial direction of the rotation shaft.

3. The developer conveying apparatus according to claim 2, wherein a shape of the first openings and the second openings is a hole such that an opening width thereof becomes larger toward the conveying directions of the developer.

4. The developer conveying apparatus according to claim 2, wherein a shape of the first openings and the second openings is a tongue-shaped cutting that bends toward the conveying directions of the developer.

5. The developer conveying apparatus according to claim 2, wherein a shape of the first and the second openings for conveying the developer in a direction from an end portion in the axial direction to a central portion in the axial direction is larger than a shape of the first and the second openings for conveying the developer in a direction from the central portion in the axial direction to the end portion in the axial direction.

6. The developer conveying apparatus according to claim 2, wherein an arrangement of the first and the second openings is constituted by a size of the openings or an interval of the arrangement that is different in order to change an amount of developer conveyed in a direction along the axial direction.

7. The developer conveying apparatus according to claim 1, wherein there exists a replenishing port, for replenishing the developer, at a position facing the rotation plate member, and the first developer conveying portion and the second developer conveying portion convey the developer in opposite directions in such a manner that a facing area facing the replenishing port in the rotation plate member is a border.

8. The developer conveying apparatus according to claim 7, wherein the first developer conveying portion is arranged at a position farther from the rotation shaft than the second developer conveying portion, wherein the first developer conveying portion conveys the developer from an end portion in an axial direction of the rotation shaft to the facing area, and the second developer conveying portion conveys the developer from the facing area to the end portion in the axial direction.

9. The developer conveying apparatus according to claim 7, wherein the first and second developer conveying portions are arranged so that the first openings and the second openings in a predetermined shape in the rotation plate member are disposed in a direction along an axial direction of the rotation shaft.

10. The developer conveying apparatus according to claim 9, wherein a shape of the first and the second openings is such that an opening width thereof becomes larger toward the conveying directions of the developer.

11. The developer conveying apparatus according to claim 9, wherein a shape of the first and the second openings is a tongue-shaped cutting that bends toward the conveying directions of the developer.

12. The developer conveying apparatus according to claim 1, wherein a plurality of rotation plate members is provided in an axial direction of the rotation shaft, and is arranged with a different rotation angle around the rotation shaft with respect to the rotation shaft.

13. The developer conveying apparatus according to claim 12, wherein the plurality of rotation plate members is arranged to partially overlap in the axial direction of the rotation shaft.

14. The developer conveying apparatus according to claim 12, wherein the first and second developer conveying portions are arranged with the first openings and the second openings in a predetermined shape in the rotation plate member which are arranged in a direction along the axial direction.

15. The developer conveying apparatus according to claim 14, wherein a shape of the first and the second openings is such that an opening width thereof becomes larger toward the conveying directions of the developer.

16. The developer conveying apparatus according to claim 14, wherein a shape of the first and the second openings is a tongue-shaped cutting that bends toward the conveying directions of the developer.

17. The developer conveying apparatus according to claim 1, wherein an amount of the developer conveyed along an axial direction of the rotation shaft by the first and second developer conveying portions is such that, around an end portion in the axial direction, an amount of the developer conveyed from a central portion in the axial direction to the end portion is less than an amount of the developer conveyed from the end portion to the central portion.

18. A developing apparatus for providing a developer to an image bearing member, comprising the developer conveying apparatus according to claim 1 as a developer conveying apparatus for conveying the developer.

19. The developing apparatus according to claim 18, further comprising:

a developer containing portion which supports the rotation plate member in a freely rotatable manner and accommodates the developer; and a developer detection member which detects the developer accommodated in the developer containing portion, wherein an amount of the developer conveyed along an axial direction of the rotation shaft by the first and second developer conveying portions is such that an amount of the developer that reaches an area where the developer detection member detects the developer is less than an amount of the developer that moves out of the area to another area.

20. The developing apparatus according to claim 18, further comprising:

a developer containing portion which supports the rotation plate member in a freely rotatable manner and accommodates the developer;

a developer detection member which is arranged on an inner wall of the developer containing portion corresponding to one end portion side in an axial direction of the rotation shaft and which detects the developer accommodated in the developer containing portion, wherein where an interval between a developer conveying portion of the first and second developer conveying portions which is closest to the one end portion side and an inner wall of the one end portion side is denoted as L1, and an interval between a developer conveying portion of the first and second developer conveying portions that is closest to the other end portion side and an inner wall of the developer containing portion at the other end portion side is denoted as L2, a relationship of L1>L2 is satisfied.

21. The developer conveying apparatus according to claim 1, wherein the first openings and second openings have a region that overlaps with each other in a radial direction of the rotation plate member.

22. The developer conveying apparatus according to claim 1, wherein the first openings are aligned in an axial direction of the rotation shaft at a first radial distance therefrom, and the second openings are aligned in the axial direction of the rotation shaft at a second radial distance therefrom, wherein the first radial distance is greater than the second radial distance.

23. The developer according to claim 1, wherein the first and second openings are completely enclosed within the rotation plate member.

24. A developer conveying apparatus for conveying a developer that develops an electrostatic latent image, comprising a rotation sheet member which rotates around a rotation shaft;

wherein the rotation sheet member has a first developer conveying portion which is provided with first openings for conveying the developer in a first axial direction of the rotation shaft; and a second developer conveying portion which is provided with second openings for conveying the developer in a second axial direction opposite to the first axial direction, wherein a shortest distance from the rotation shaft to the first openings is different than a shortest distance from the rotation shaft to the second openings.

25. The developer conveying apparatus according to claim 24, wherein the first openings and the second openings are each arranged in a predetermined shape in the rotation sheet member along an axial direction of the rotation shaft.

26. The developer conveying apparatus according to claim 25, wherein a shape of the first openings and the second openings is a hole such that an opening width thereof becomes larger toward the conveying directions of the developer.

27. The developer conveying apparatus according to claim 25, wherein a shape of the first openings and the second openings is a tongue-shaped cutting that bends toward the conveying directions of the developer.

28. A developing apparatus for providing a developer to an image bearing member, comprising the developer conveying apparatus according to claim 24 as a developer conveying apparatus for conveying the developer.

29. The developer conveying apparatus according to claim 24, wherein the first openings and second openings have a region that overlaps with each other in a radial direction of the rotation sheet member.

* * * * *